US007511691B2

(12) United States Patent
Hirayama et al.

(10) Patent No.: US 7,511,691 B2
(45) Date of Patent: Mar. 31, 2009

(54) DISPLAY DRIVE DEVICE AND DISPLAY APPARATUS HAVING SAME

(75) Inventors: Ryuichi Hirayama, Musashimurayama (JP); Shunji Kashiyama, Kanagawa-ken (JP); Naoki Inagaki, Hamura (JP)

(73) Assignee: Casio Computer Co., Ltd., Tokyo (JP)

( * ) Notice: Subject to any disclaimer, the term of this patent is extended or adjusted under 35 U.S.C. 154(b) by 595 days.

(21) Appl. No.: 11/023,116

(22) Filed: Dec. 27, 2004

(65) Prior Publication Data

US 2005/0156862 A1 Jul. 21, 2005

(30) Foreign Application Priority Data

Dec. 26, 2003 (JP) ..... 2003-435928

(51) Int. Cl.
*G09G 3/36* (2006.01)

(52) U.S. Cl. ..... 345/88; 345/98

(58) Field of Classification Search ..... 345/98, 345/100, 204, 87, 88
See application file for complete search history.

(56) References Cited

U.S. PATENT DOCUMENTS

| | | | | |
|---|---|---|---|---|
| 6,980,191 | B2 * | 12/2005 | Nakamura et al. | 345/98 |
| 7,006,072 | B2 | 2/2006 | Ahn | |
| 7,030,865 | B2 | 4/2006 | Ishiyama | |
| 7,102,606 | B2 | 9/2006 | Miyajima et al. | |
| 2003/0011581 | A1 | 1/2003 | Tanaka et al. | |

FOREIGN PATENT DOCUMENTS

| | | | |
|---|---|---|---|
| CN | 1319833 | A | 10/2001 |
| CN | 1389847 | A | 1/2003 |
| CN | 1417771 | A | 5/2003 |
| JP | 11-167373 | A | 6/1999 |
| JP | 2003-058133 | A | 2/2003 |
| JP | 2003-122313 | A | 4/2003 |
| JP | 2003-140626 | A | 5/2003 |
| KR | 2003-38332 | A | 5/2003 |

OTHER PUBLICATIONS

Japanese Office Action (and English translation thereof) dated May 12, 2008, issued in a counterpart Japanese Application.

* cited by examiner

*Primary Examiner*—Kevin M Nguyen
(74) *Attorney, Agent, or Firm*—Frishauf, Holtz, Goodman & Chick, P.C.

(57) ABSTRACT

A liquid crystal display apparatus to which the present invention is applied has a first data conversion circuit and a second data conversion circuit. The first data conversion circuit converts each predetermined number of display data included in prepared display data into pixel data in which the respective display data are arranged in a predetermined arranging order and in time-series. The second data conversion circuit is provided for each the predetermined number of signal lines included in the display apparatus and sequentially applies display signal voltages corresponding to the pixel data to the predetermined number of signal lines respectively. The liquid crystal display apparatus equalizes the amounts of charges to be written in respective display pixels by reversing the arranging order of the display data in the pixel data and the order of applying the display signal voltages to the signal lines per field period or per horizontal scanning period.

25 Claims, 22 Drawing Sheets q-TH FIELD (ODD ORDINAL NUMBER FIELD)

(q+1)TH FIELD (EVEN ORDINAL NUMBER FIELD)

| | | | | | |
|---|---|---|---|---|---|
| Gm/VDnpx | APPLICATION TIMING | T1 | T2 | T1 | T2 |
| | DIFFERENCE FROM Vcom CENTER | ±0 | − (NEGATIVE) | ±0 | − (NEGATIVE) |
| | Vcom POLARITY | L | H | L | H |

| | | | | | |
|---|---|---|---|---|---|
| Gm/VDnpx | APPLICATION TIMING | T1 | T2 | T3 | T4 |
| | DIFFERENCE FROM Vcom CENTER | ±0 | − (NEGATIVE) | + (POSITIVE) | ±0 |
| | Vcom POLARITY | L | H | L | H |

DISPLAY DRIVE DEVICE AND DISPLAY APPARATUS HAVING SAME

CROSS-REFERENCE TO RELATED APPLICATION

This application is based upon and claims the benefit of priority from the prior Japanese Patent Application No. 2003-435928, filed Dec. 26, 2003, the entire contents of which is incorporated herein by reference.

BACKGROUND OF THE INVENTION

1. Field of the Invention

The present invention relates to a display drive device, a drive control method of the same, and a display apparatus having the same, and particularly relates to a display drive device suitably applicable to a display panel conforming to an active-matrix type drive system, a drive control method of the same, and a display apparatus having the same.

2. Description of the Related Art

In recent years, a liquid crystal display (LCD) has been frequently used as a display apparatus (display) for displaying image and character information, etc. in imaging apparatuses such as widely-spreading digital video cameras and digital still cameras, and in portable apparatuses such as cellular phones and personal digital assistants (PDA). Further, a liquid crystal display is widely used as a monitor or display apparatus for information terminals such as computers and for visual equipment such as television sets. A liquid crystal display used for such purposes is thin-shaped, light-weighted, adaptable to low power consumption, and excellent in display quality.

A liquid crystal display according to prior art will now be briefly described.

FIG. 21 is a block diagram showing a schematic configuration of a liquid crystal display according to prior art having display pixels of a thin-film transistor type.

FIG. 22 is an equivalent circuit diagram showing one example of a principal configuration of a liquid crystal display panel according to prior art.

As illustrated in FIG. 21 and FIG. 22, a liquid crystal display 100P according to prior art comprises a liquid crystal display panel (display panel) 110P in which display pixels Px are arranged two-dimensionally, a gate driver (scanning drive circuit) 120P, a source driver (signal drive circuit) 130P, an LCD controller 150P, a display signal generation circuit 160P, and a common signal drive amp (drive amp) 170P. The gate driver 120P sequentially scans the group of display pixels Px in each row of the liquid crystal display panel 110P to set the scanned pixels Px to a selected state. The source driver 130P outputs a display signal voltage based on a video signal, simultaneously to the group of display pixels Px in the row set to the selected state. The LCD controller 150P generates and outputs control signals (horizontal control signal, vertical control signal, etc.) for controlling operation timings of the gate driver 120P and the source driver 130P. The display signal generation circuit 160P extracts various timing signals (horizontal synchronous signal, vertical synchronous signal, composite synchronous signal, etc.) from video signals and outputs the extracted signals to the LCD controller 150P, and it also generates display data comprising a luminance signal and outputs it to the source driver 130P. The common signal drive amp 170P applies, based on a polarity inverting signal FRP generated by the LCD controller 150P, a common signal voltage Vcom having a predetermined voltage polarity to a common electrode (opposing electrode) provided in common for the display pixels Px in the liquid crystal display panel 110P.

As shown in FIG. 22, the liquid crystal display panel 110P comprises opposing transparent substrates between which a plurality of scanning lines SL and a plurality of data line DL are arranged so as to intersect each other orthogonally in row and column directions, and the plurality of display pixels (liquid crystal display pixels) Px are arranged adjacent to the intersections of the scanning lines SL and data lines DL. Each display pixel Px comprises a pixel transistor TFT, a pixel capacitor (liquid crystal capacitor) Clc, and a compensating capacitor (storage capacitor) Cs. The pixel transistor TFT is formed of a thin film transistor whose source-drain (current path) is connected between a pixel electrode and the data line DL and whose gate (control terminal) is connected to the scanning line SL. The pixel capacitor Clc is formed of liquid crystal molecules sealed and held between the pixel electrode and the common electrode opposing to the pixel electrode and provided in common for all the display pixels Px. The compensating capacitor Cs is a capacitor which is arranged in parallel with the pixel capacitor Clc and stores a signal voltage applied to the pixel capacitor Clc.

The scanning lines SL and the data lines DL arranged in the liquid crystal display panel 110P are connected via connection terminals TMg and TMs to the gate driver 120P and the source driver 130P which are provided independently from the liquid crystal display panel 110P. An electrode (compensating electrode) at the other end of the compensating capacitor Cs receives application of a predetermined voltage Vcs (for example, a common signal voltage Vcom) via a common connection lines CL.

In the liquid crystal display 100P having the above-described configuration, display data supplied from the display signal generation circuit 160P and corresponding to display pixels in one row of the liquid crystal display panel 110P are sequentially acquired by the source driver 130P based on a horizontal control signal supplied from the LCD controller 150P. In the meantime, based on a vertical control signal supplied from the LCD controller 150P, the gate driver 120P sequentially applies a scanning signal to the scanning line SL arranged in the liquid crystal display panel 110P. As a result, the pixel transistors TFT of the group of display pixels Px in each row are turned on and set to the selected state in which each pixel can acquire a display signal voltage. In synchronization with the timing the group of display pixels Px in each row are selected, the source driver 130 supplies a display signal voltage based on the acquired display data simultaneously to the display pixels Px via the data lines DL.

As a result, via the pixel transistor TFT of each display pixel Px set to the selected state, the liquid crystal molecules sealed in the pixel capacitor Clc change their orientation state in accordance with the display signal voltage and perform a predetermined gradational display operation, and the compensating capacitor Cs connected in parallel to the pixel capacitor Clc is charged with the voltage applied to the pixel capacitor Clc. By this series of operations being repeated for the rows included in one screen, desired image information based on a video signal is displayed on the liquid crystal display panel 110P.

As shown in FIG. 21 and FIG. 22, such a mounting structure for a liquid crystal display has been known, in which the gate driver 120P and source driver 130P as peripheral circuits are provided independently from insulating substrates such as grass substrates or the like forming the liquid crystal display panel 110P (in which the pixel array is formed), and the liquid crystal display panel 110P and the peripheral circuits are electrically connected via the connection terminals TMg and TMs. In addition to this structure, also known is a structure in which the gate driver 120 and source driver 130 are formed on the insulating substrates integrally with the pixel array (display pixels Px) by employing polysilicon transistors.

However, the liquid crystal display as described above has the following problems.

That is, according to the structure shown in FIG. 21 and FIG. 22, if the liquid crystal display panel 110P is adapted to higher precision in order to improve the display quality, the number of data lines is increased. Along with this, the number of output terminals of the gate driver 120 and source driver 130 is increased and the circuit scale of each driver (the gate driver 120 and the source driver 130) is expanded. Thus, the size of the chip forming each driver becomes large, resulting in a problem that the mounting area of each driver is increased and the cost of each driver circuit is raised. A further problem is that along with the expansion of the circuit scale, the power consumed by each driver circuit is increased.

Moreover, as the number of output terminals of the gate driver 120P and source driver 130P is increased, the number of connection terminals for connecting the liquid crystal display panel 110P and each driver is increased and the pitch between the connection terminals becomes small. Therefore, the number of steps required in connection process is increased and a higher connection precision is required, leading to a problem that the production cost is raised.

As a technique for solving the problem regarding the number of steps required for connecting the liquid crystal display panel and peripheral circuits and the problem of connection precision, there is known a structure in which a liquid crystal display panel, a gate driver, and a source driver are integrally formed on a single insulating substrate, with the use of polysilicon transistors. However, unlike transistor devices such as an amorphous silicon transistor, for which a production technique has been established and from which a good device property (operation property) can be obtained, a polysilicon transistor has to go through a complicated production process that costs high, and its operation property is insufficient. Therefore, there has been a problem that the production cost required for a liquid crystal display apparatus becomes higher and a stable display characteristic is hard to obtain.

SUMMARY OF THE INVENTION

The present invention relating to a display drive device for driving, based on display data, a display panel on which display pixels are arranged adjacent to intersections of a plurality of signal lines and a plurality of scanning lines and a display apparatus having the same has an advantage of being able to downsize the display drive device, reduce the power to be consumed, and obtain a good display quality.

A display drive device according to a first aspect of the present invention for acquiring the above-stated advantage comprises: a first data conversion circuit which converts each predetermined number of display data into pixel data in which the respective display data are arranged in time-series and in a predetermined arranging order; a display signal voltage generation circuit which generates display signal voltages which correspond to the pixel data and are to be applied to display pixels via a plurality of signal lines; a second data conversion circuit which is provided for each the predetermined number of signal lines of the plurality of signal lines, converts the display signal voltages so as to correspond to the arranging order of the display data in the pixel data, and sequentially applies the display signal voltages to the predetermined number of signal lines respectively; and a control section which changes an order of applying the display signal voltages to the signal lines, at a predetermined cycle.

The display drive device further comprises a data holding circuit which acquires the display data which are supplied from outside, and holds the display data in parallel with one another, and the first data conversion circuit converts the display data held by the data holding circuit into the pixel data.

The control section changes the arranging order of the display data in the pixel data at the predetermined cycle.

The control section reverses the arranging order of the display data in the pixel data and the order of applying the display signal voltages to the signal lines, per field period in which a display operation for one screen of a display panel is performed or per horizontal period in which a display operation for one row of a display panel is performed. Further, the control section sets the arranging order of the display data in the pixel data and the order of applying the display signal voltages to the signal lines, in a manner that, with a predetermined plural number of field periods set as one cycle, fluctuations in pixel potentials stored in the display pixels based on the display signal voltages applied via the signal lines are canceled in the predetermined plural number of field periods.

The second data conversion circuit includes a plurality of switches which apply the display signal voltages to the predetermined number of signal lines respectively, and the control section includes a switch drive control circuit which generates, based on a timing signal, switch toggling signals for controlling electrical conductivity of the plurality of switches in the second data conversion circuit.

A display drive device according to a second aspect of the present invention for acquiring the above-stated advantage comprises a first data conversion circuit which converts each predetermined number of display data into pixel data in which the respective display data are arranged in time-series; a display signal voltage generation circuit which generates display signal voltages which correspond to the pixel data and are to be applied to display pixels via a plurality of signal lines; a second data conversion circuit which is provided for each the predetermined number of signal lines of the plurality of signal lines, converts the display signal voltages so as to correspond to an arranging order of the display data in the pixel data, and sequentially applies the display signal voltages to the predetermined number of signal lines in writing periods which are set variedly for the respective signal lines; and a control section which sets the writing periods for the respective signal lines, to periods corresponding to writing speeds at the display pixels.

The control section sets the writing period for the signal line to which the display signal voltage is applied at a last timing among the predetermined number of signal lines, to a period which continues until writing of the display signal voltages in the display pixels is completed.

A display apparatus according to a third aspect of the present invention for acquiring the above-stated advantage comprises a scanning drive circuit which sequentially applies scanning signals to a plurality of scanning lines to set display pixels to a selected state; a data holding circuit which acquires display data which is supplied from outside, and holds the display data in parallel with one another; a first data conversion circuit which converts each predetermined number of the display data held by the data holding circuit, into pixel data in which the respective display data are arranged in a predetermined arranging order and in time-series; a display signal voltage generation circuit which generates display signal voltages which correspond to the pixel data and are to be applied to display pixels via the plurality of signal lines; a second data conversion circuit which is provided for each the predetermined number of signal lines of the plurality of signal lines, converts the display signal voltage so as to correspond to the arranging order of the display data in the pixel data, and sequentially applies the display signal voltages to the predetermined number of signal lines respectively; and a control section which changes the arranging order of the display data in the pixel data and an order of applying the display signal voltages to the signal lines, at a predetermined cycle. The second data conversion circuit is integrally formed on a single insulating substrate on which a display panel is formed.

The control section reverses the arranging order of the display data in the pixel data and the order of applying the display signal voltages to the signal lines, per field period in which a display operation for one screen of the display panel is performed or per horizontal period in which a display operation for one row of the display panel.

The control section set the arranging order of the display data in the pixel data and the order of applying the display signal voltages to the signal lines, in a manner that, with a predetermined plural number of field periods set as one cycle, fluctuations in pixel potentials stored in the display pixels based on the display signal voltages applied via the signal lines are canceled in the predetermined plural number of field periods.

The second data conversion circuit includes a plurality of switches which apply the display signal voltages to the predetermined number of signal lines respectively, and the control section includes a switch drive control circuit which generates, based on a timing signal, switch toggling signals for controlling electrical conductivity of the plurality of switches in the second data conversion circuit. The switch drive control circuit is, for example, formed integrally with the scanning drive circuit.

Each of the plurality of display pixels includes a pixel transistor whose gate electrode is connected to the scanning line, whose drain electrode is connected to the signal line, and whose source electrode is connected to a pixel electrode, a pixel capacitor which is formed of liquid crystal molecules sealed between the pixel electrode and a common electrode opposing to the pixel electrode and provided in common, and a compensating capacitor connected in parallel to the pixel capacitor, and orientation state of the liquid crystal molecules of the pixel capacitor is controlled by the display signal voltage being applied to the pixel electrode via the pixel transistor.

A display apparatus according to a fourth aspect of the present invention for acquiring the above-stated advantage comprises: a scanning drive circuit which sequentially applies scanning signals to a plurality of scanning lines to set display pixels to a selected state; a data holding circuit which acquires display data which are supplied from outside, and holds the display data in parallel with one another; a first data conversion circuit which converts each predetermined number of the display data held by the data holding circuit, into pixel data in which the respective display data are arranged in a predetermined arranging order and in time-series; a display signal voltage generation circuit which generates display signal voltages which correspond to the pixel data and are to be applied to display pixels via a plurality of signal lines; a second data conversion circuit which is provided for each the predetermined number of signal lines of the plurality of signal lines, converts the display signal voltages so as to correspond to the arranging order of the display data in the pixel data, and sequentially applies the display signal voltages to the predetermined number of signal lines respectively in writing periods which are set variedly for the respective signal lines; and a control section which sets the writing periods for the respective signal lines, to periods corresponding to writing speeds at the display pixels.

The control section sets the writing period for the signal line to which the display signal voltage is applied at a last timing among the predetermined number of signal lines, to a period which continues until writing of the display signal voltages in the display pixels is completed.

A drive control method of a display drive device according to a fifth aspect of the present invention for acquiring the above-stated advantage comprises: acquiring display data and holding the display data in parallel with one another; converting each predetermined number of the held display data, into pixel data in which the respective display data are arranged in a predetermined arranging order and in time-series; generating display signal voltages which correspond to the pixel data; sequentially applying the display signal voltages to each the predetermined number of signal lines of a plurality of signal lines, in an order corresponding to the arranging order of the display data in the pixel data; and changing the arranging order of the display data in the pixel data and the order of applying the display signal voltages to the signal lines, at a predetermined cycle.

The changing of the arranging order of the display data in the pixel data and the order of applying the display signal voltages to the signal lines reverses the arranging order of the display data in the pixel data and the order of applying the display signal voltages to the signal lines, per field period in which a display operation for one screen of a display panel is performed or per horizontal period in which a display operation for one row of a display panel is performed.

The changing of the arranging order of the display data in the pixel data and the order of applying the display signal voltages to the signal lines sets the arranging order of the display data in the pixel data and the order of applying the display signal voltages to the signal lines, in a manner that, with a predetermined plural number of field periods set as one cycle, fluctuations in pixel potentials stored in display pixels based on the display signal voltages applied via the signal lines are canceled in the predetermined plural number of field periods.

A drive control method of a display drive device according to a sixth aspect of the present invention for acquiring the above-stated advantage comprises: acquiring display data and holding the display data in parallel with one another; converting each predetermined number of the held display data, into pixel data in which the respective display data are arranged in a predetermined arranging order and in time-series; generating display signal voltages which correspond to the pixel data; and sequentially applying the display signal voltages corresponding to the pixel data to each the predetermined number of signal lines of a plurality of signal lines, in an order corresponding to the arranging order of the display data in the pixel data, in writing periods which are variedly set so as to correspond to writing speeds at display pixels.

The applying of the display signal voltages to each the predetermined number of signal lines sets the writing period for the signal line to which the display signal voltage is applied at a last timing among the predetermined number of signal lines, to a period which continues until writing of the display signal voltages in the display pixels is completed.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENTS

A display drive device according to the present invention, a drive control method of the same, and a display apparatus having the display drive device will be specifically explained by illustrating embodiments thereof.

First, the entire configuration of the display apparatus having the display drive device according to the present invention will be shown and then the display drive device and the drive control method of the same will be explained in detail. In the embodiments to be shown below, a case will be explained where the display drive device and display apparatus according to the present invention are applied to a liquid crystal display apparatus employing an active-matrix type drive system.

First Embodiment of the Display Apparatus

Figure 1:
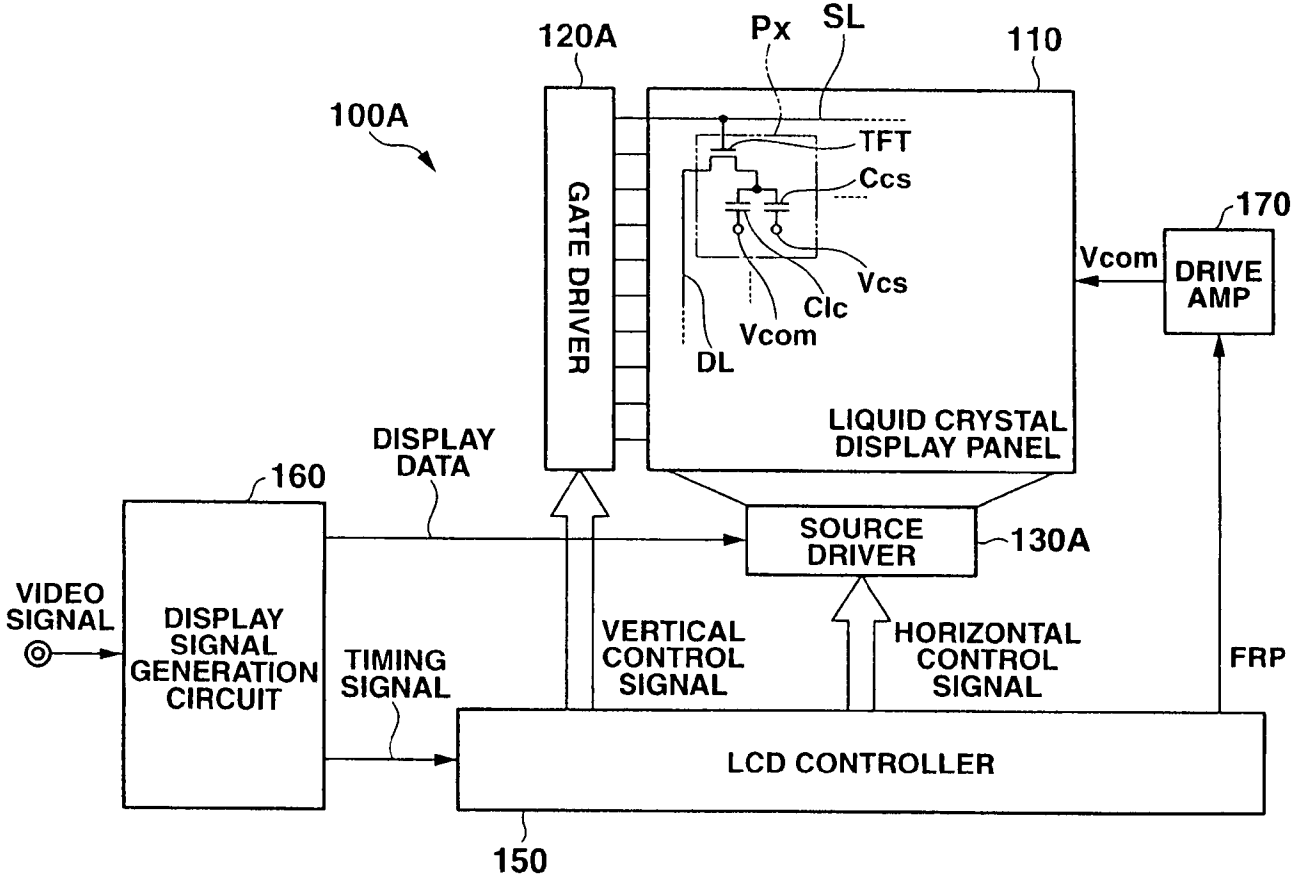
FIG. 1 is a schematic block diagram showing the entire configuration of a first embodiment of a liquid crystal display apparatus to which a display apparatus according to the present invention is applied.
Figure 21:
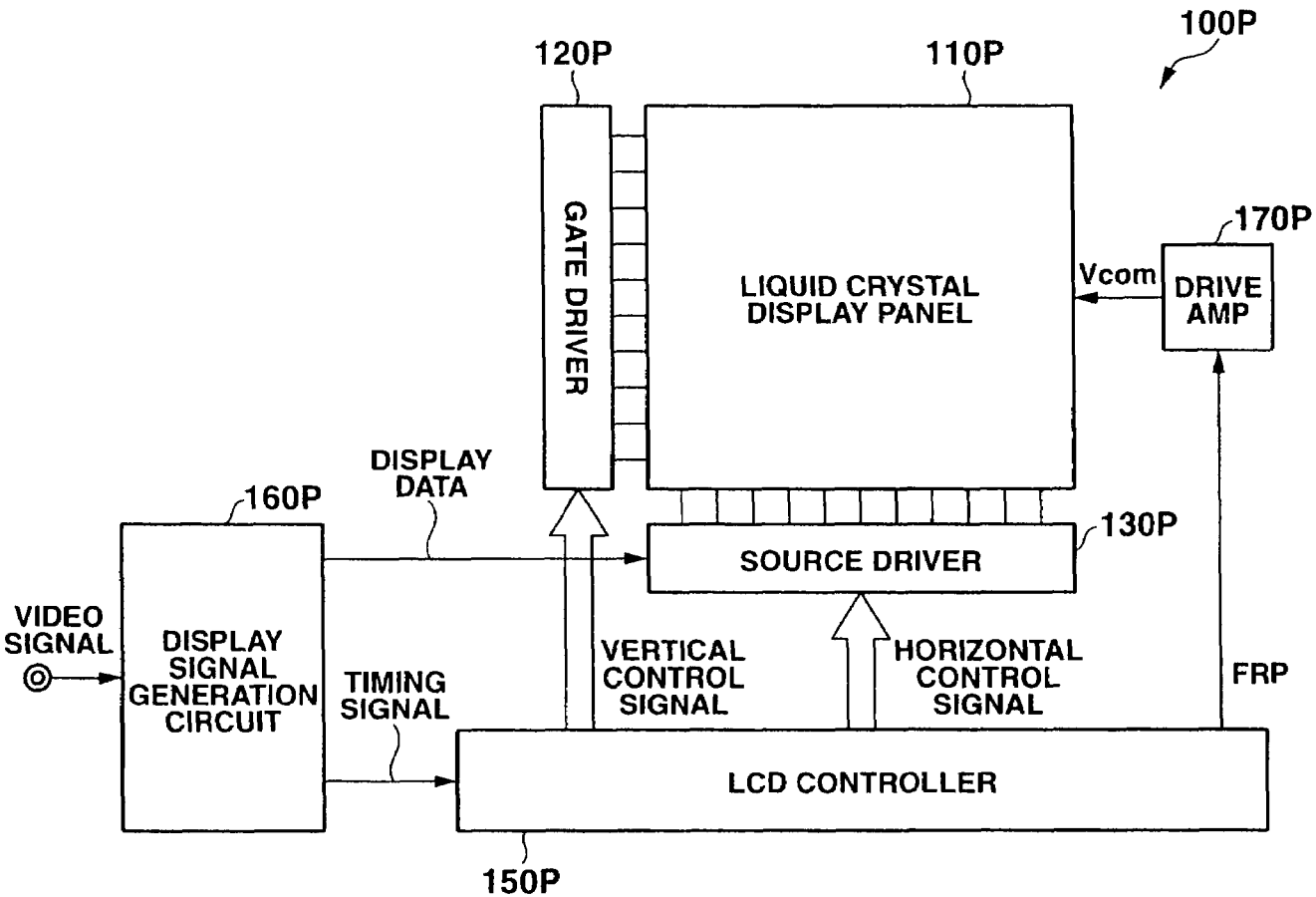
FIG.21 PRIOR ART
FIG. 21 is a block diagram showing a schematic configuration of a liquid crystal display apparatus having thin-film-transistor-type display pixels according to prior art.
Figure 22:
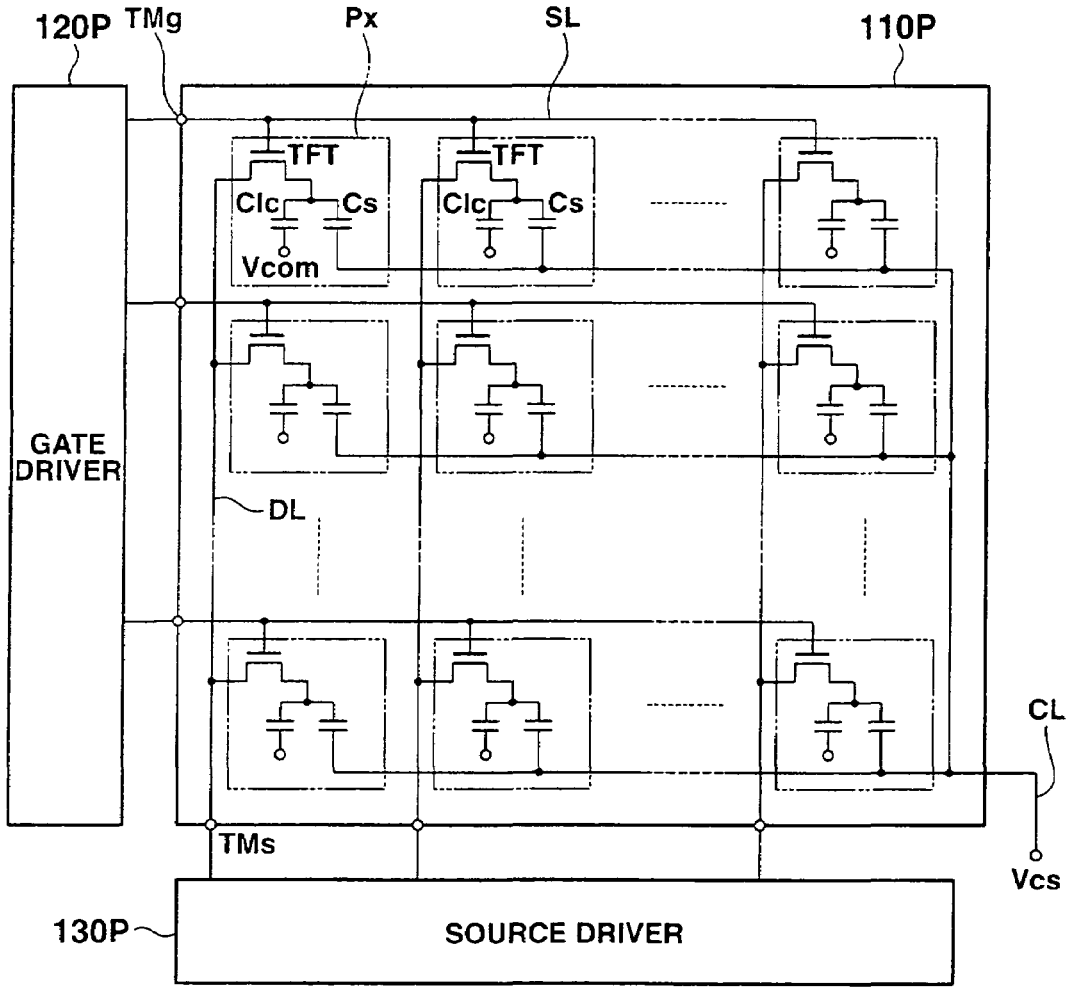
FIG.22 PRIOR ART
FIG. 22 is an equivalent circuit diagram showing an example of a principal part of a liquid crystal display panel according to prior art.

FIG. 1 is a schematic block diagram showing the entire configuration of the first embodiment of a liquid crystal display apparatus to which the display apparatus according to the present invention is applied. Elements equal to those in the above-described prior art (FIG. 21 and FIG. 22) will be given similar or same reference numerals, and explanation for such elements will be omitted.

As shown in FIG. 1, the liquid crystal display apparatus 100A according to the present embodiment comprises a liquid crystal display panel 110, a gate driver (scanning drive circuit) 120A, a source driver (signal drive circuit) 130A, an LCD controller 150, a display signal generation circuit 160, and a common voltage drive amp (drive amp) 170. On the liquid crystal display panel 110, a plurality of display pixels Px are arranged two-dimensionally, adjacent to the intersections of a plurality of scanning lines SL and a plurality of data lines DL. The gate driver 120A sequentially applies a scanning signal to the scanning lines SL at predetermined timings. The source driver 130A dividedly applies a display signal voltage comprising serial data based on display data to the data lines DL at predetermined timings. The LCD controller 150 generates and outputs various control signals (vertical control signal, horizontal control signal, and data conversion control signal to be described later) for controlling the operation states of at least the gate driver 120A, the source driver 130A, and a later-described transfer switch circuit 140. The display signal generation circuit 160 generates display data to be supplied to the source driver 130A based on a video signal, and generates a timing signal to be supplied to the LCD controller 150. The common voltage drive amp 170 applies a common signal voltage having a predetermined voltage polarity to a common electrode which is provided in common for all the display pixels Px.

According to the first embodiment, the source drive 130A and the gate driver 120A can be formed as driver chips which are independent from an insulating substrate such as a grass substrate on which is formed a pixel array including the plurality of two-dimensionally arranged display pixels Px constituting the liquid crystal display panel 110.

Figure 2:
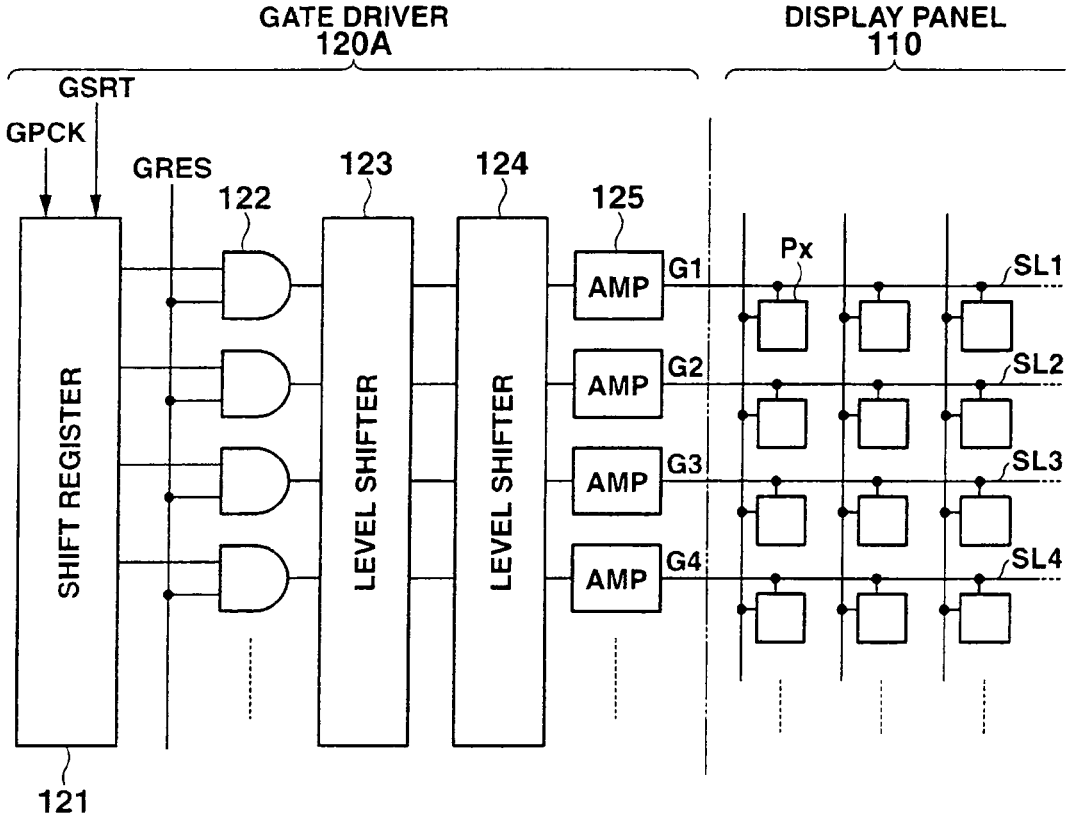
FIG. 2 is a schematic configuration diagram showing an example of a gate driver.
Figure 3:
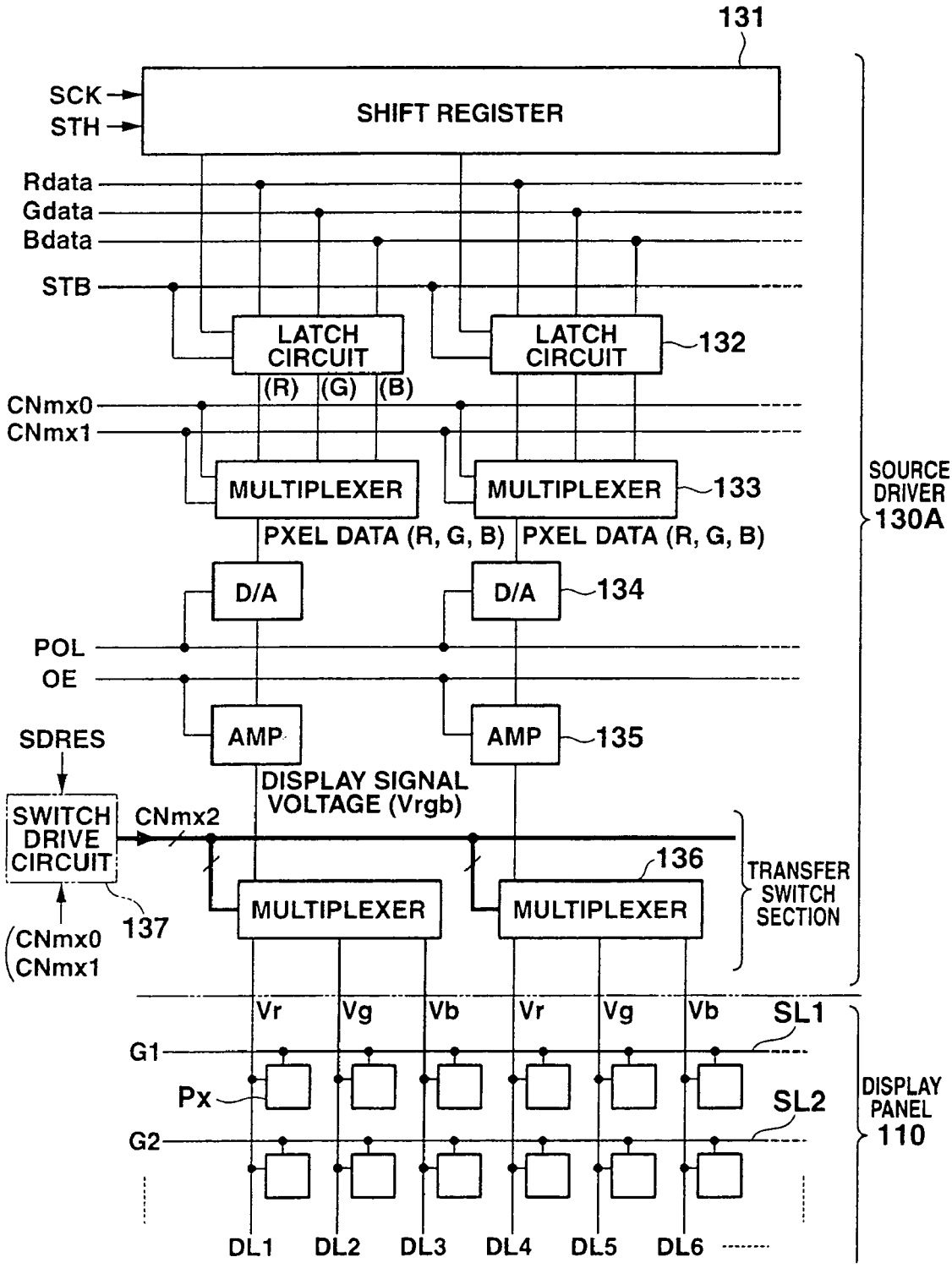
FIG. 3 is a schematic configuration diagram showing an example of a source driver.
Figure 4:
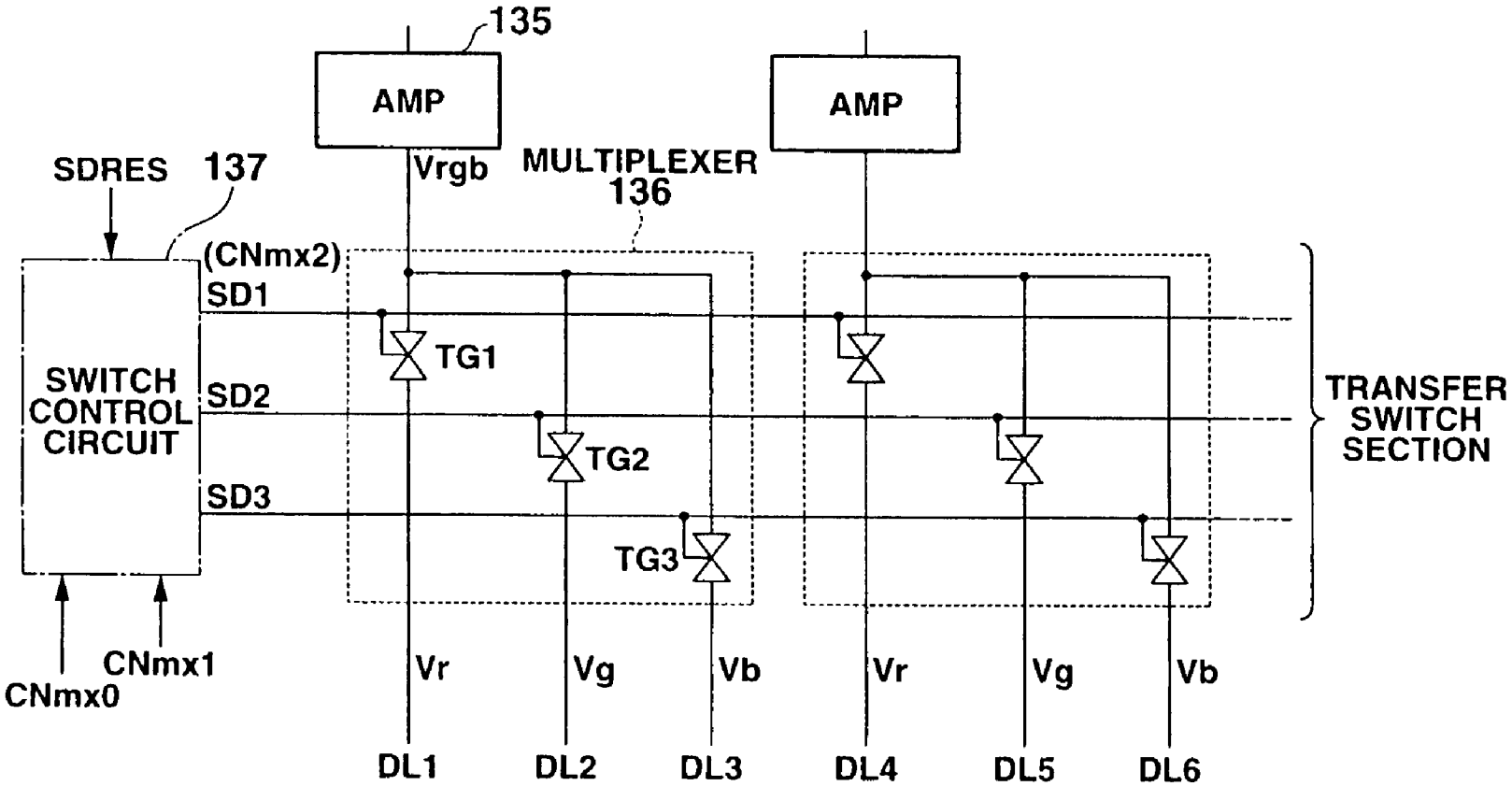
FIG. 4 is a schematic configuration diagram showing an example of a switch drive circuit.

Each element of the above-described liquid crystal display apparatus will now be specifically described with reference to FIG. 1 through FIG. 4. Since the liquid crystal display panel 110 (pixel array) has the same configuration as that shown in the prior art (the liquid crystal display panel 110P shown in FIG. 22), a detailed explanation thereof will be omitted. FIG. 2 is a schematic configuration diagram showing one example of the gate driver. FIG. 3 is a schematic configuration diagram showing one example of the source driver. FIG. 4 is a schematic configuration diagram showing one example of a switch drive circuit.

As shown in FIG. 2, the gate driver 120A comprises a shift register 121, two-input logical operation AND circuits (hereinafter abbreviated as "AND circuit") 122, plural-staged (two-staged) level shifters 123 and 124, and output amps (shown as "amp" in the drawing) 125. The shift register 121 sequentially outputs shifted signals at predetermined timings, based on a gate start signal GSRT and a gate clock signal GPCK which are supplied as vertical control signals from the LCD controller 150. The AND circuit 122 receives a shift signal output from the shift register 121 as input to its one input point, and receives a gate reset signal GRES supplied as a vertical control signal from the LCD controller 150 as input to its other input point. The level shifters 123 and 124 set (boost) a signal output from the AND circuit 122 to a predetermined signal level. The level shifters 123 and 124 and the output amps 125 serve to drive the shift register 121 at a low voltage, and are provided adequately at the output stage of the gate driver 120A depending on the signal level of a scanning signal to be applied to the scanning lines SL (display pixels Px).

In the gate driver 120A having this configuration, when a gate start signal GSRT and a gate clock signal GPCK are supplied as vertical control signals from the LCD controller 150, the shift register 121 sequentially shifts the gate start signal GSRT based on the gate clock signal GPCK. The shift register 121 inputs the shifted signal to one input point of each of the plurality of AND circuits 122 which are provided correspondingly to the scanning lines SL.

In a state where the gate reset signal GRES is set to a high level ("1") (driven state of the gate driver 120A), the other input point of the AND circuit 122 always receives a level "1". As a result, the signal of the high level ("1") is output from the AND circuit 122 at a timing at which the shifted signal is output from the shift register 121, based on the gate start signal GSRT and the gate clock signal GPCK. Scanning signals G1, G2, G3, . . . having a predetermined high level are generated through the level shifters 123 and 124 and the output amps 125, and sequentially applied to the scanning lines SL1, SL2, SL3, . . . Thereby, the group of display pixels Px, which are connected in each row extending along each of the scanning lines SL1, SL2, SL3, . . . to which the scanning signals G1, G2, G3, . . . are applied, are simultaneously set to a selected state.

On the other hand, in a state where the gate reset signal GRES is set to a low level ("0") (reset state of the gate driver 120A), the other input point of the AND circuit 122 always receives a level "0". As a result, regardless of the presence/absence of an output of a shifted signal from the shift register 121, a signal having the low level ("0") is always output from the AND circuit 122, so that scanning signals G1, G2, G3, . . . having a predetermined low level are generated and the group of display pixels Px connected in each row extending along each of the scanning lines SL1, SL2, SL3, . . . are set to a non-selected state.

As shown in FIG. 3, for example, the source driver 130A comprises a shift register 131, latch circuits (data holding circuits) 132, input multiplexers (first data conversion circuits) (shown as "multiplexer" in the drawing) 133, digital-analog converters (hereinafter abbreviated as "D/A converter" and shown as "D/A" in the drawing) 134, output amps (shown as "amp" in the drawing) 135, and dividing multiplexers (second data conversion circuits) (shown as "multiplexer" in the drawing) 136. The shift register 131 sequentially outputs shifted signals at predetermined timings based on a horizontal shift clock signal SCK and a horizontal period start signal STH. The latch circuit 132 sequentially acquires, in response to the shifted signals output from the shift register 131, plural lines of display data supplied in parallel from the display signal generation circuit 160, for example, three lines of display data Rdata, Gdata, and Bdata respectively including a red component (R), a green component (G), and a blue component (B) which constitute image information. At the same time, in response to a control signal STB, the latch circuit 132 collectively outputs the display data acquired in a prior horizontal period. The input multiplexer 133 converts each of the display data Rdata, Gdata, and Bdata (i.e., parallel data) collectively output from the latch circuit 132, into pixel data RGBdata comprising serial data in which each display data is arranged in time-series, based on multiplexer control signals CNmx0 and CNmx1. The D/A converter 134 digital-analog-converts the pixel data RGBdata output from the input multiplexer 133, to generate an analog signal (display signal voltage) having a predetermined signal polarity based on a polarity control signal POL. The output amp 135 amplifies the signal obtained by analog-converting the pixel data RGBdata to a predetermined signal level based on an output enable signal OE. The output amp 135 outputs the amplified signal to the dividing multiplexer 136, as a display signal voltage Vrgb having display signal voltages Vr, Vg, and Vb corresponding to the display data Rdata, Gdata, and Bdata arranged in time-series. The dividing multiplexer 136 converts (divides) the display signal voltage Vrgb output from the output amp 135 into each of the display signal voltages Vr, Vg, and Vb, based on a multiplexer control signal CNmx2 which is based on multiplexer control signals CNmx0 and CNmx1, and a switch reset signal SDRES. The dividing multiplexer 136 applies the display signal voltages Vr, Vg, and Vb obtained by the conversion to each of the groups of data lines DL1 to DL3, data lines DL4 to DL6, . . . at timings corresponding to the arrangement of each display data in the pixel data.

The digital-analog converter 134 and the output amp 135 constitute the display signal voltage generation circuit according to the present invention.

As shown in FIG. 4, the dividing multiplexer 136 comprises transfer gates (switches) TG1 to TG3 which are supplied with the display signal voltage Vrgb output from the output amp 135 and are connected to the data lines DL1 to DL3, DL4 to DL6, . . . which are connected to the display pixels Px. The multiplexer control signal CNmx2 includes switch toggling signals SD1 to SD3. According to the configuration shown in FIG. 4, the on state of the transfer gates TG1 to TG3 is selectively set based on the switch toggling signals SD1 to SD3.

In FIG. 4, the configuration including the plurality of dividing multiplexers 136 is shown as a transfer switch section.

The signals to be supplied to the components described above are supplied from the LCD controller 150. The horizontal shift clock signal SCK, the horizontal period start signal STH, the control signal STB, the polarity control signal POL, and the output enable signal OE are horizontal control signals. The multiplexer control signals CNmx0 and CNmx1 and the switch reset signal SDRES are data conversion control signals.

The multiplexer control signal CNmx2 (switch toggling signals SD1 to SD3) supplied to the dividing multiplexer 136 may be one of horizontal control signals supplied from the LCD controller 150 as well as the above-described control signals. Or, a switch drive circuit (switch drive control circuit)

137 may be provided as shown in FIG. 3 and FIG. 4, and the multiplexer control signal CNTmx2 may be generated and supplied by the switch drive circuit 137. In this case, the multiplexer control signal CNmx2 is generated, for example, as shown in the table 1 below, based on the data conversion control signals (multiplexer control signals CNmx0 and CNmx1 and switch reset signal SDRES) which are supplied from the LCD controller 150.

TABLE 1

| C Nmx0 | C Nmx1 | SDRES | SD1 | SD2 | SD3 |
|---|---|---|---|---|---|
| L | L | L | L | L | L |
| L | H | L | L | L | L |
| H | L | L | L | L | L |
| H | H | L | L | L | L |
| L | L | H | H | L | L |
| L | H | H | L | H | L |
| H | L | H | L | L | H |
| H | H | H | L | L | L |

In a case where the switch reset signal SDRES having a low level (L) is supplied from the LCD controller 150, the switch toggling signals SD1 to SD3 are set to a low level (L) regardless of the signal levels of the multiplexer control signals CNmx0 and CNmx1, and supply of the display signal voltage to each data line DL is cut. In a case where the switch reset signal SDRES having a high level (H) is supplied from the LCD controller 150, any of the switch toggling signals SD1 to SD3 is set to a high level (H) based on the signal levels of the multiplexer control signals CNmx0 and CNmx1. And any of the transfer gates TG1 to TG3 to which the switch toggling signal SD1, SD2, or SD3 having a high level is applied is turned on, and the display signal voltage is supplied to the data line DL.

The switch drive circuit 137 may be provided in the source driver 130A or outside the source driver 130A. Further, as shown in a later-described second embodiment of the display apparatus (see FIG. 19), the switch drive circuit may be provided in the gate driver.

In FIG. 4, the dividing multiplexer 136 comprises a plurality of transfer gates. However, FIG. 4 shows one example of a circuit configuration that is applicable to the display apparatus according to the present invention. The dividing multiplexer 36 may have other configuration as long as such a configuration divides the display signal voltage to the data lines at timings corresponding to the arrangement of each display data Rdata, Gdata, or Bdata in the pixel data RGBdata.

The source driver 130A having this configuration is parallely and sequentially supplied from the display signal generation circuit 160, with display data Rdata, Gdata, and Bdata corresponding to the display pixels Px in each row adapted to the colors RGB. After the display data Rdata, Gdata, and Bdata corresponding to one group of display pixels adapted to RGB colors are acquired, the display data Rdata, Gdata, and Bdata are converted into pixel data RGBdata comprising serial data in which each display data is arranged in time-series, based on the data conversion control signals. Then, a display signal voltage Vrgb, in which display signal voltages Vr, Vg, and Vb corresponding to the display data Rdata, Gdata, and Bdata in the pixel data RGBdata are arranged in time-series, is generated. Then, the display signal voltages Vr, Vg, and Vb are divided to the data lines DL1 to DL3, DL4 to DL6, . . . based on the data conversion control signals. As a result, for example, the display signal voltage Vr corresponding to the red component Rdata in the display data is supplied to the data lines DL1, DL4, DL7, . . . DL(k+1). The display signal voltage Vg corresponding to the green component Gdata is supplied to the data lines DL2, DL5, DL8, . . . DL(k+2). The display signal voltage Vb corresponding to the blue component Bdata is supplied to the data lines DL3, DL6, DL9 . . . DL(k+3). (k=0, 1, 2, 3, . . . ).

The arranging order of the display data Rdata, Gdata, and Bdata in converting the display data Rdata, Gdata, and Bdata into the pixel data RGBdata, and the order of applying the display signal voltages Vr, Gg, and Vb to the data lines DL1 to DL3, DL4 to DL6, . . . are synchronously controlled by the data conversion control signals (multiplexer control signals CNmx0 and CNmx1 and switch reset signal SDRES). In this case, the order of applying the display signal voltages Vr, Gg, and Vb is controlled between the normal order of Vr-Vg-Vb and the reverse order of Vb-Vg-Vr.

The display signal generation circuit 160 extracts a horizontal synchronous signal, a vertical synchronous signal, and a composite synchronous signal from a video signal (composite vide signal or the like) supplied from the outside of the liquid crystal display apparatus 100A, and supplies the extracted signals to the LCD controller 150 as timing signals. At the same time, the display signal generation circuit 160 executes predetermined display signal generation processes (pedestal clamp, chroma process, etc.) to extract luminance signals (display data) of R, G, and B colors included in the video signal, and outputs the luminance signals to the source driver 130A as analog signals or digital signals.

The LCD controller 150 generates a horizontal control signal and a vertical control signal based on the horizontal synchronous signal and the vertical synchronous signal supplied from the display signal generation circuit 160, and various timing signals such as a system clock, etc., and supplies the generated signals to the gate driver 120A and the source driver 130A. The LCD controller 150 generates the data conversion control signals (multiplexer control signals CNmx0 and CNmx1 and switch reset signal SDRES) for controlling the operation states of the input multiplexers 133A and the dividing multiplexers 136, as a function unique to the present invention. The LCD controller 150 supplies the data conversion control signals to the source driver 130A (assume that the switch drive circuit 137 is included in the source driver 130A).

The drive control method of the liquid crystal display apparatus according to the first embodiment will now be explained with reference to the drawings.

(First Drive Control Method)

Figure 5:
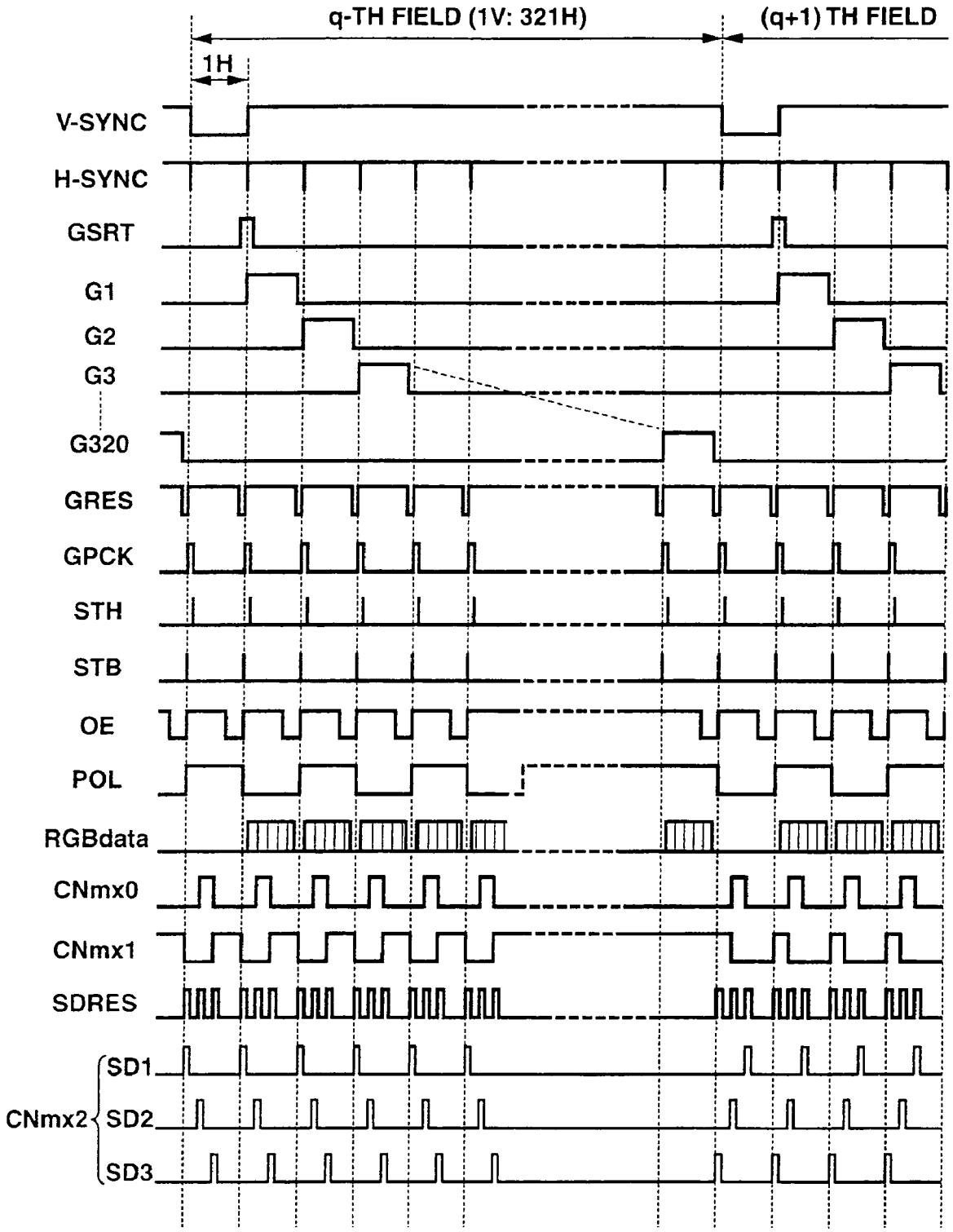
FIG. 5 is a timing chart showing a first drive control method.
Figure 6:
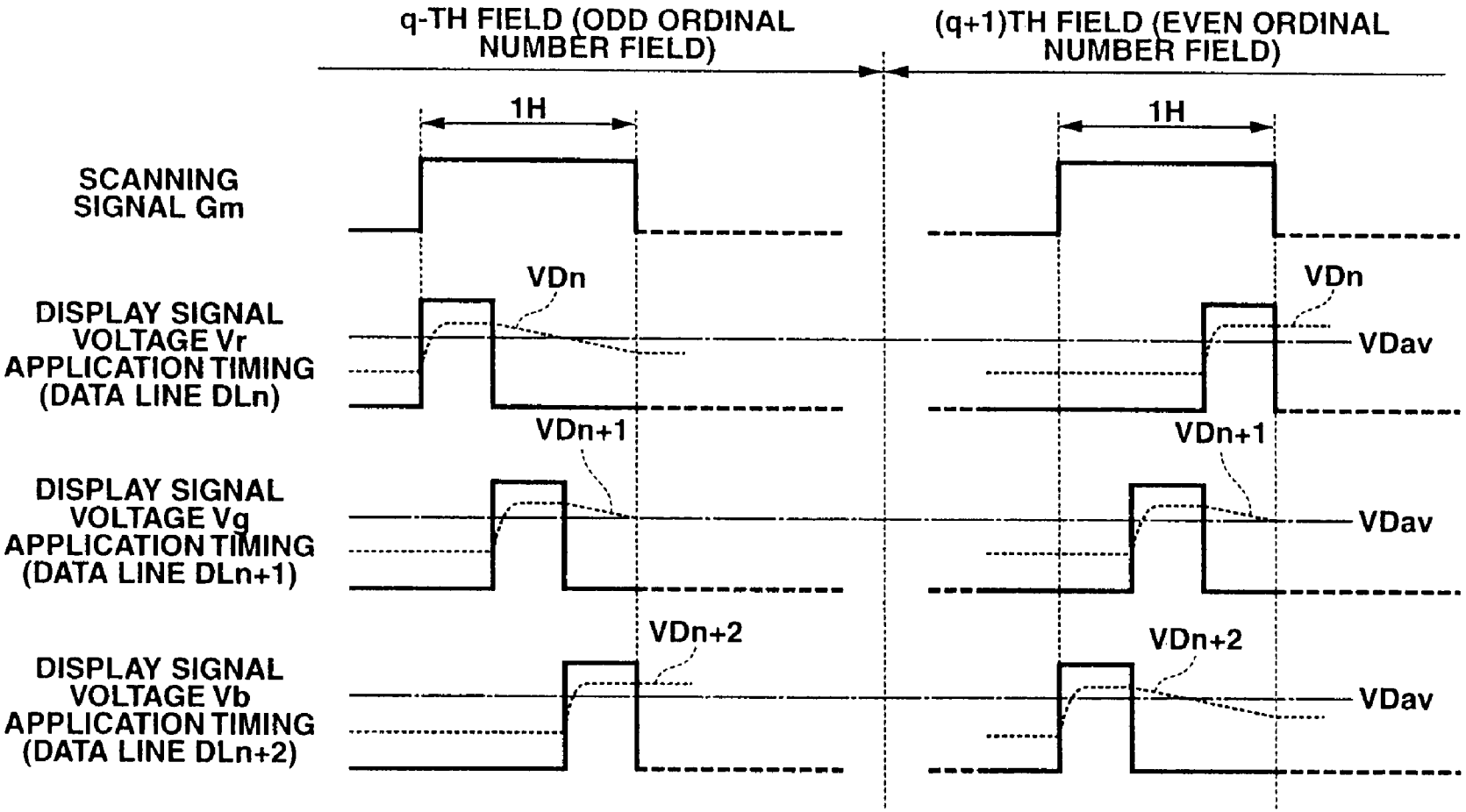
FIG. 6 is a timing chart of the substantial part showing the control concept of the first drive control method.

FIG. 5 is a timing chart showing the first drive control method. FIG. 6 is a timing chart of the substantial part showing the control concept of the first drive control method.

Here, the dividing multiplexer 136 has the configuration shown in FIG. 4, and is controlled by the switch toggling signals SD1 to SD3.

According to the drive control method of the liquid crystal display apparatus having the above-described configuration, with one horizontal period (1H) set as one cycle, the gate driver 120A applies a scanning signal Gi to a scanning line SLn on the n-th row and sets the group of display pixels Px on the row to a selected state, as shown in the timing chart of FIG. 5.

During this selected period, at predetermined timings based on the data conversion control signals, the source driver 130A causes the input multiplexer 133 and the dividing multiplexer 136 to respectively execute conversion of display data into pixel data and dividing of the pixel data in synchronization with each other, for each group of three data lines DL1 to DL3, DL4 to DL6.

That is, as shown in the timing chart of FIG. 5, the input multiplexer 133 converts display data Rdata, Gdata, and Bdata corresponding to the display pixels Px connected to the data lines DL1 to DL3, DL4 to DL6, . . . into pixel data RGBdata comprising serial data in which each display data is arranged in time-series. Then, a display signal voltage Vrgb in which display signal voltages Vr, Vg, and Vb corresponding to display data Rdata, Gdata, and Bdata are arranged in time-series is supplied to the dividing multiplexer 136. The dividing multiplexer 136 sequentially divides the display signal voltage Vrgb into display signal voltages Vr, Vg, and Vb corresponding to the data lines DL1 to DL3, DL4 to DL6, . . . of the respective data line groups and applies the voltages to the data lines, so that the display data is written on each display pixel Px on the selected row.

This writing operation is repeated during one field period (one vertical period; 1V), so that scanning signals G1, G2, G3, . . . are sequentially applied to the scanning lines SL1, SL2, SL3, . . . constituting the liquid crystal display panel 110 and display data for one screen of the liquid crystal display panel 110 are written on the display pixels Px. According to the present embodiment, the liquid crystal display panel 110 includes 320 scanning lines SL.

According to the first drive control method, the multiplexer control signals CNmx0 and CNTmx1 are changed per each field period as shown in the timing chart of FIG. 5. That is, for example, in the q-th field period which is an odd ordinal number field period, with the group of display pixels Px in each row set to the selected state, the display signal voltages Vr, Vg, and Vb divided for the respective data lines DL1 to DL3, DL4 to DL6 . . . in each group are sequentially applied thereto in the order (normal order) of Vr-Vg-Vb.

On the other hand, in the (q+1)th field period which is an even ordinal number field period, with the group of display pixels Px in each row set to the selected state, the display signal voltages Vr, Vg, and Vb divided for the respective data lines DL1 to DL3, DL4 to DL6 . . . in each group are sequentially applied thereto in the order (reverse order) of Vb-Vg-Vr.

Thus, each display pixel Px is set to a gradational state corresponding to the applied display data and desired image information is displayed on the liquid crystal display panel 110.

A characteristic effect of the first drive control method will now be specifically described by employing a comparative example.

Figure 7:
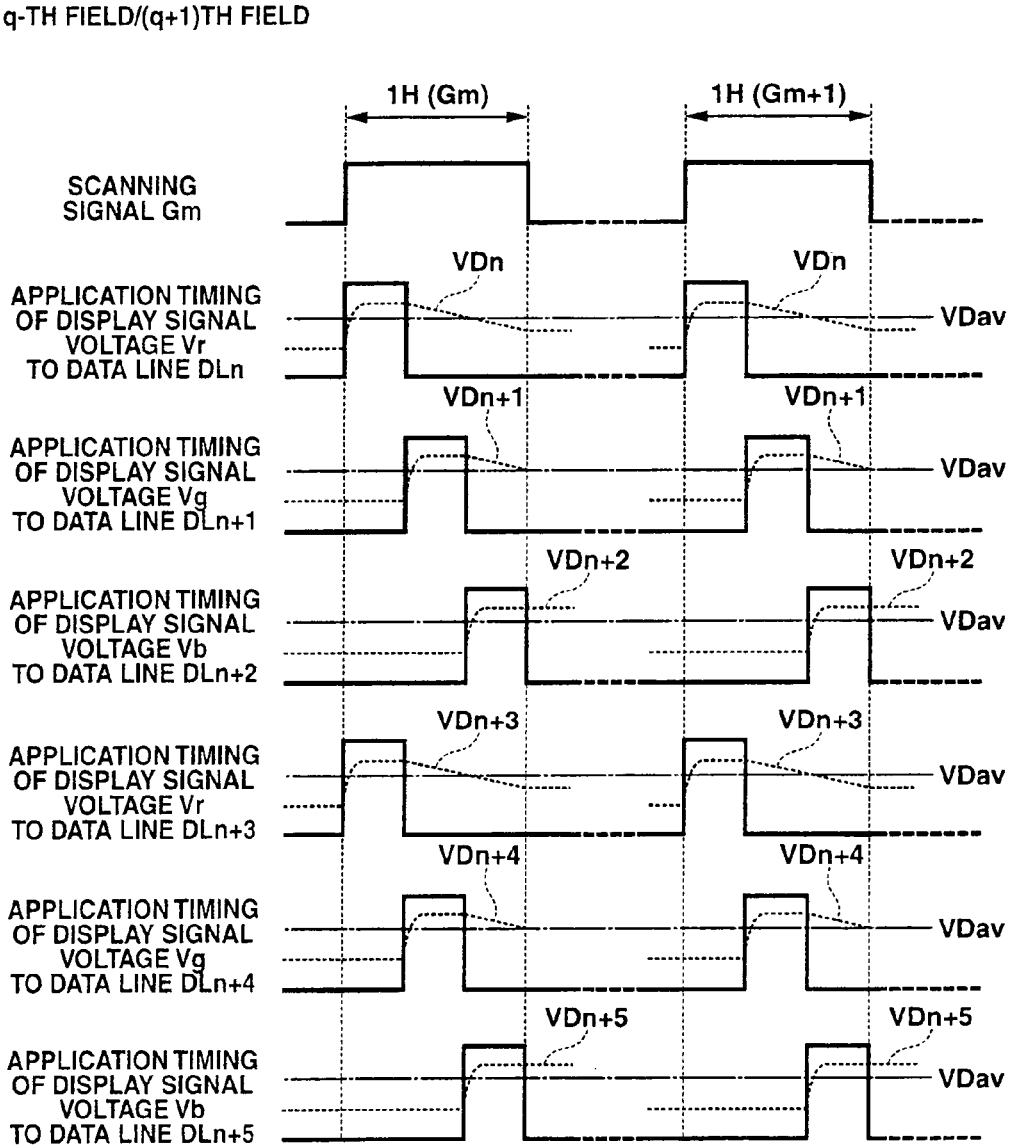
FIG. 7 is a timing chart showing an example of another drive control method to be compared with the first drive control method.
Figure 8:
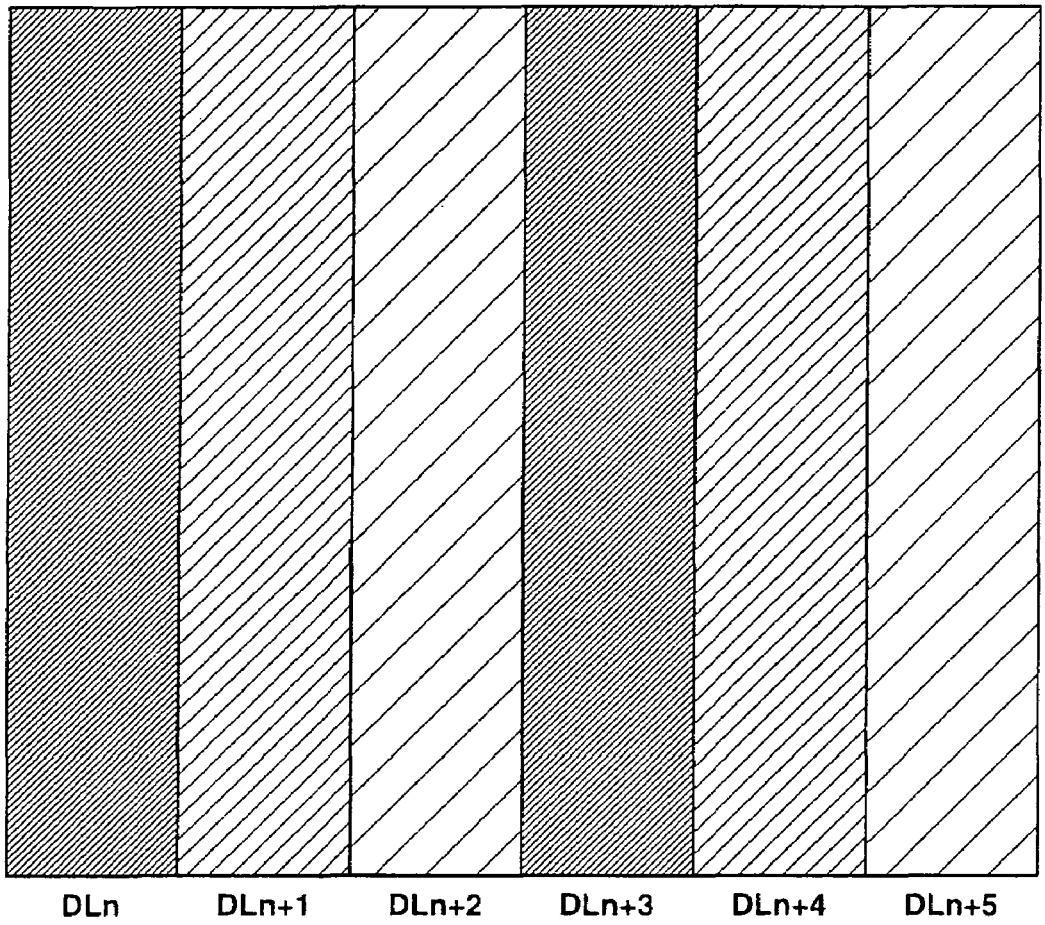
FIG. 8 is a conceptual diagram of display quality obtained by the drive control method shown in FIG. 7.

FIG. 7 is a timing chart showing an example of another drive control method to be compared with the above-described method. FIG. 8 is a conceptual diagram of display quality obtained by the drive control method shown in FIG. 7.

The timing chart shown in FIG. 7 concerns selected periods (1) which are set by scanning signals Gm and Gm+1 applied generally continuously, however, shows these selected periods apart from each other for the sake of easier understanding.

As described above, the first drive control method is characterized by inverting the order of applying (supplying) the divided display signal voltages Vr, Vg, and Vb to the data lines (display pixels Px) between an odd ordinal number field period and an even ordinal number field period. As compared with this, according to the drive control method (hereinafter referred to as "comparative example") shown in FIG. 7, the order of applying (supplying) the divided display signal voltages Vr, Vg, and Vb to the data lines (display pixels Px) is fixed regardless of an odd ordinal number field period or an even ordinal number field period.

As shown in FIG. 5 and FIG. 7, according to the first drive control method and the drive control method of the comparative example, the writing operation to be performed on the data lines (display pixels Px) is executed in a selected period during which a scanning signal Gm is applied to the scanning line. The selected period is set to be longer than a period (each writing period) required for each display signal voltage to be written (according to the first embodiment, selected period (1)≧total of writing periods).

According to the drive control method of the comparative example, the order of applying the divided display signal voltages Vr, Vg, and Vb to the data lines (display pixels Px) is fixed. As shown in FIG. 7, after the operation of writing the display signal voltage Vr is completed, the scanning signal Gm is still applied to the display pixels Px on the row concerned until the selected period ends. Therefore, the pixel transistor TFT (see FIG. 1) of each display pixel Px continues to be on. This causes a problem that charges stored in each display pixel Px in response to the display signal voltage Vr, Vg, or Vb are partially leaked via an electrostatic protection element (for example, a diode) provided to the data line DL, reducing the amount of charges stored.

The amount of charges leaked from each display pixel Px is dependent on the order of applying the display signal voltages Vr, Vg, and Vb to the display pixels Px (data lines DL) (or dependent on the time left in the selected period after writing operation). For example, as shown in FIG. 7, since the data line DLn to which the display signal voltage Vr is applied has a long time left in the selected period after the writing operation is completed, the amount of charges leaked therefrom is large (see the change in a data line voltage VDn indicated by a dot line in FIG. 7). Since the data line DLn+2 to which the display signal voltage Vb is applied has almost no time left in the selected period after the writing operation is completed, leakage of charges hardly occurs (see the change in a data line voltage VDn+2 indicated by a dot line in FIG. 7). The amount of charges leaked from the data line DL+1 to which the display signal voltage Vg is applied is between these leak amounts (see the change in a data line voltage VDn+1 indicated by a dot line in FIG. 7). As a result, unevenness occurs in the amounts of writing charges stored in the respective display pixels Px. In FIG. 6 and FIG. 7, VDav represents the average voltage of data line voltages VDn to VDn+5.

Therefore, according to the drive control method in which the order of applying the divided display signal voltages Vr, Vg, and Vb to the data lines DL (display pixels Px) is fixed, any adjacent data lines DL (any adjacent groups of display pixels Px arranged in the column direction) have a constant difference in their leak current amounts. Therefore, even in a case where the display signal voltages are set such that a display image (raster display) having no unevenness in the luminance will be displayed, a problem arises that as shown in FIG. 8, differences (bright or dark) in the luminance occur in the display image in vertical stripe shapes and the image quality is deteriorated. In FIG. 8, the darkness or brightness of the display luminance is shown by differences in hatching density (dot density).

Hence, according to the first drive control method, as shown in FIG. 6, the order of applying the divided display signal voltages Vr, Vg, and Vb to the data lines (display pixels Px) is inverted between an odd ordinal number field period and an even ordinal number field period. Because of this, the amounts of charges leaked from the display pixels periods Px are generally equalized among the data lines DL to which the display signal voltages Vr, Vg, and Vb are applied, in each pair of odd ordinal number field period (q-th field period) and an even ordinal number field period ((q+1)th field period). As a result, the total of data line voltages VDn applied in the q-th field period and in the (q+1)th field period, the total of data line voltages VDn+1 applied in these periods, and the total of data line voltages VDn+2 applied in these periods are generally equalized. The difference in the leak current amount between adjacent data lines DL (between groups of display pixels Px arranged in the column direction) is reduced, making it possible to prevent occurrence of differences in the luminance in stripe shapes and improve the display quality.

According to the liquid crystal display apparatus having the above-described configuration, the display signal voltages to be supplied to the display pixels Px connected to the data lines DL constituting the liquid crystal display panel 110 are converted in the source driver 130A, into time-division serial data for each data line group including a plurality of data lines DL. The display signal voltages corresponding to the plurality of data lines DL can be transmitted through a single signal line. The numbers of D/A converters 134 and output amps 135 provided in the source driver 130A and the number of signal lines connecting these elements to the transfer switch circuits (dividing multiplexers 136) can therefore be reduced to 1/given number (1/number of data lines included in each data line group). Accordingly, the circuit scale of the source driver 130A can be reduced and the chip size of the source driver 130A can be reduced. And because the power consumed by the D/A converters 134 and output amps 135 can be reduced, the power consumed by the source driver 130A can be reduced.

According to the first embodiment, display data supplied as parallel data in j lines (j is an arbitrary positive integer; 3 lines (j=3) in a case where the color components of RGB are concerned as described above) is converted by the multiplexer (input multiplexer 133) into serial data and transmitted to the transfer switch circuit. The dividing multiplexer 136 divides the serial data to the plurality (j number) of data lines DL. The source driver 130A having this configuration executes signal processes at j times as high an operation speed (at j times as large a clock frequency) as that of a conventional (well-known) source driver which simply acquires display data, converts it to display signal voltages, and outputs the voltages.

The display data to be processed by the source driver 130A (multiplexer 133 and dividing multiplexer 136) is not limited to data in three lines corresponding to the color components RGB in the above-described display data, but may be parallel data in 2 lines or 3 or more lines. In this case, multiplexers having a predetermined number of input or output terminals corresponding to the number of lines in the display data are employed.

(Second Drive Control Method)

The following explanation will be made by timely referring to the configuration of the above-described liquid crystal display apparatus (see FIG. 1 through FIG. 4). Explanation for the operations same as those in the first drive control method will be simplified or omitted.

Figure 9:
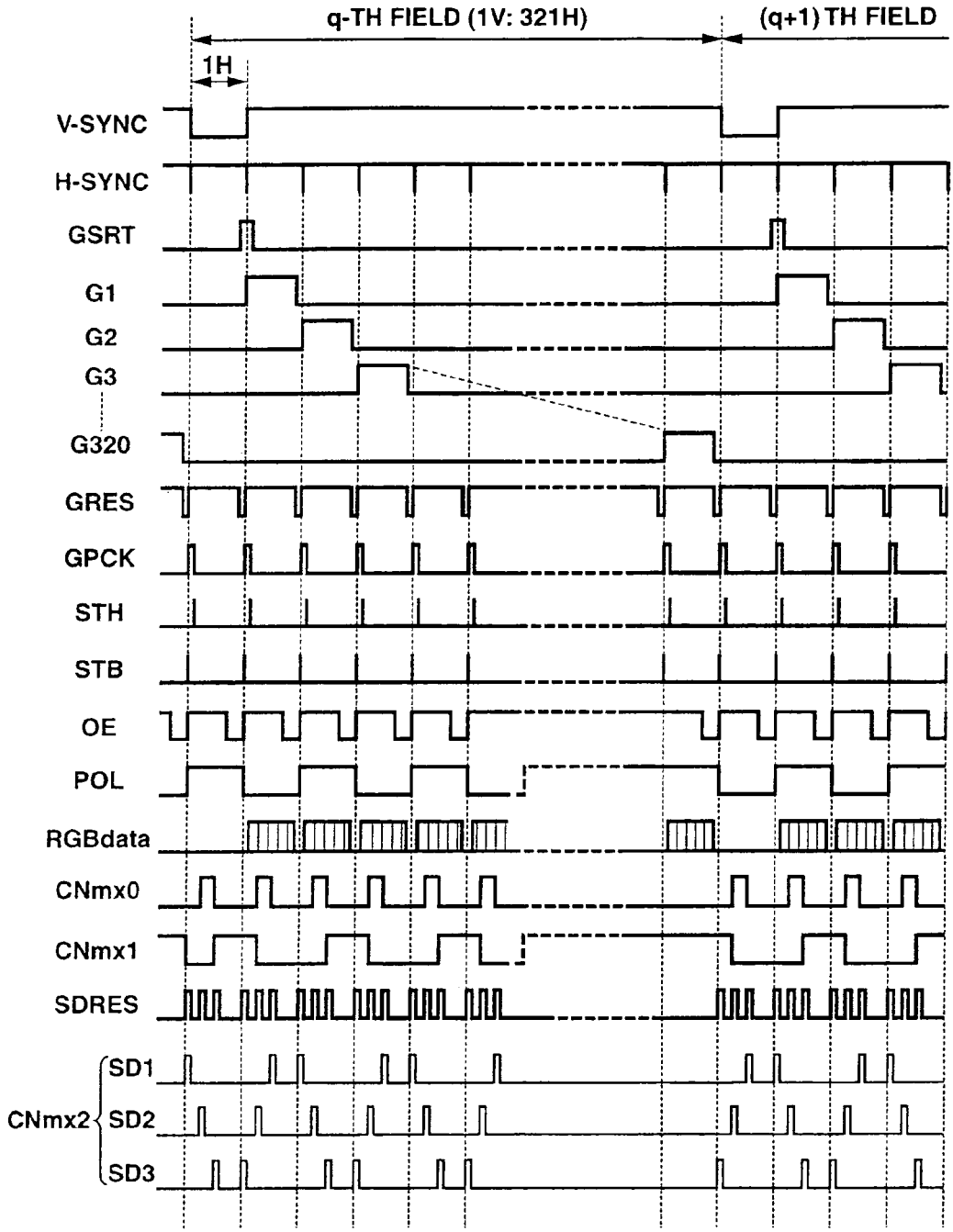
FIG. 9 is a timing chart showing a second drive control method.
Figure 10:
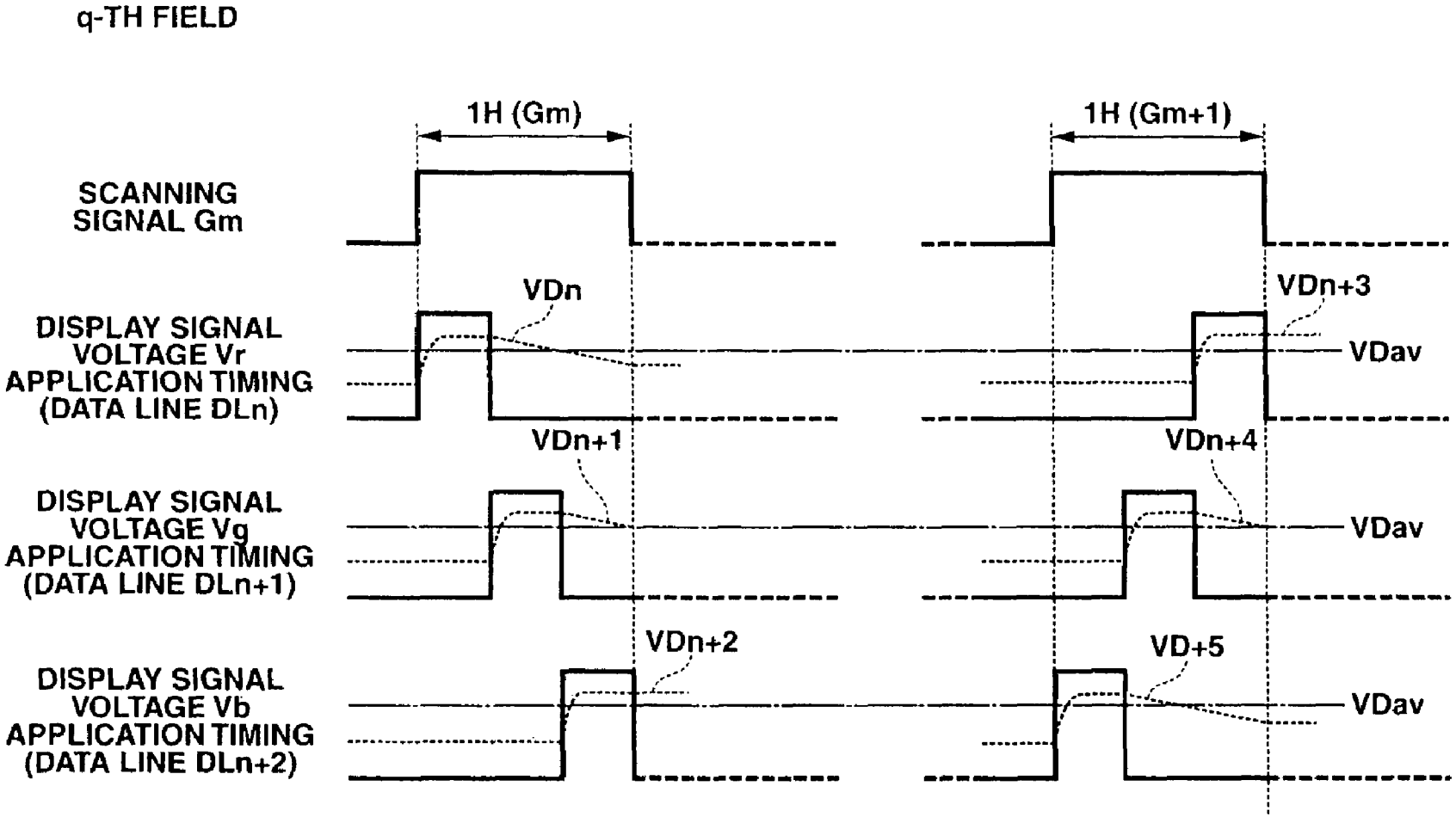
FIG. 10 is a timing chart of the substantial part showing the control concept of the second drive control method.
Figure 11:
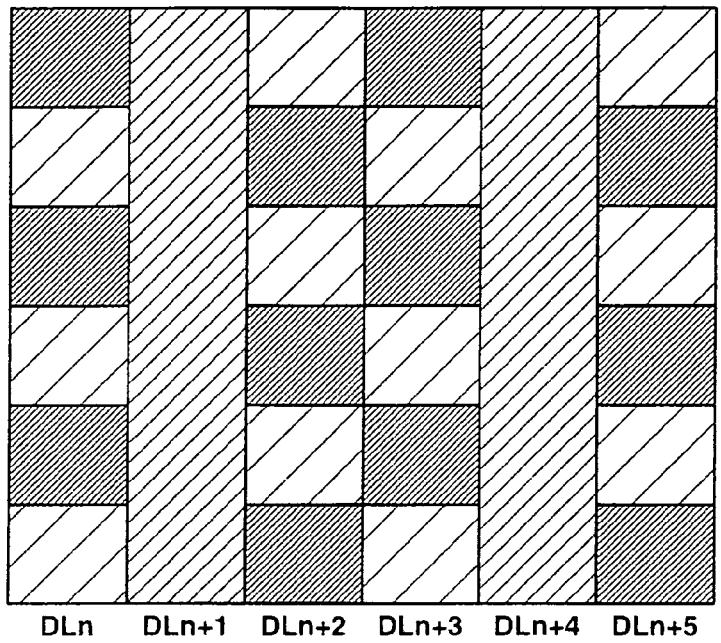
FIG. 11 is a conceptual diagram showing display quality obtained by the second drive control method.
Figure 11:
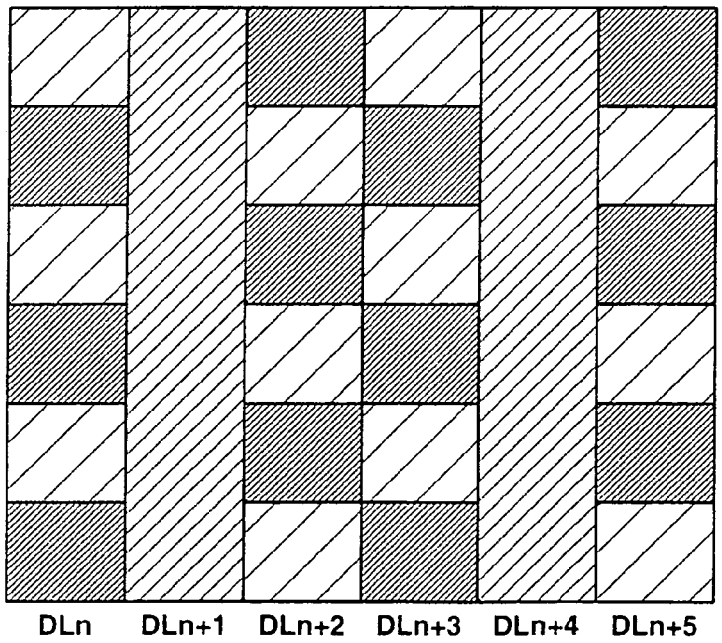

FIG. 9 is a timing chart showing the second drive control method. FIG. 10 is a timing chart of the substantial part showing the control concept of the second drive control method. FIG. 11 is a conceptual diagram of display quality obtained by the second drive control method.

According to the above-described first drive control method, the multiplexer control signals CNmx0 and CNmx1 are changed per field period, so that the dividing operation of the dividing multiplexer 136 in the source driver 130A, i.e., the order of applying the display signal voltages Vr, Vg, and Vb is changed between field periods. According to the second drive control method, the multiplexer control signals CNmx0 and CNmx1 are changed per field period and per horizontal period (selected period).

That is, according to the first drive control method, the order of applying the display signal voltages Vr, Vg, and Vb is switched between the normal order of Vr-Vg-Vb and the reverse order of Vb-Vg-Vr per field period, as shown in FIG. 6. Because of this, a field period in which the data line voltages VDn and VDn+2 greatly changes (decreases) and a field period in which these voltages do not substantially change are repeated for the data lines DLn and DLn+2 to which the display signal voltages Vr and Vb are applied. Meanwhile, concerning the data line DLn+1 to which the display signal voltage Vg is applied, substantially the same change occurs in the data line voltage VDn+1 in any field period. Since the luminance in the display image corresponding to the data lines DLn and DLn+2 changes per field period, a flicker might be caused in a case where a certain image such as a raster display or the like is displayed.

Hence according to the second drive control method, the above-described liquid crystal display apparatus changes the multiplexer control signals CNmx0 and CNmx1 per field period and also changes them per horizontal period (selected period). Further, the order of applying the display signal voltages Vr, Vg, and Vb, which are applied to the data lines DL by the dividing multiplexer 136 in the source driver 130A is switched between the normal order and the reverse order per field period likewise the above-described first drive control method (see FIG. 6), and also switched by the dividing multiplexer 136 between the normal order and the reverse order per selected period (per scanning line SL) as shown in FIG. 10.

Due to this, the order of applying the divided display signal voltages Vr, Vg, and Vb to the data lines DL (display pixels Px) is switched at least per selected period (per horizontal period). Therefore, as compared with the first drive control method, changes in the luminance of the display image due to the differences in leak current amount between the data lines DL (groups of display pixels Px arranged in the column direction) occur at a shorter cycle. As a result, even in a case where a certain image such as a raster display or the like is displayed, flickers are less recognizable and the display quality can be improved. FIG. 11 shows the darkness or brightness of the display luminance by differences in hatching density (dot density), likewise FIG. 8.

(Third Drive Control Method)

The following explanation will be made by timely referring to the configuration of the above-described liquid crystal display apparatus (see FIG. 1 to FIG. 4). Explanation for the operations same as those in the first and second drive control methods will be simplified or omitted.

Figure 12:
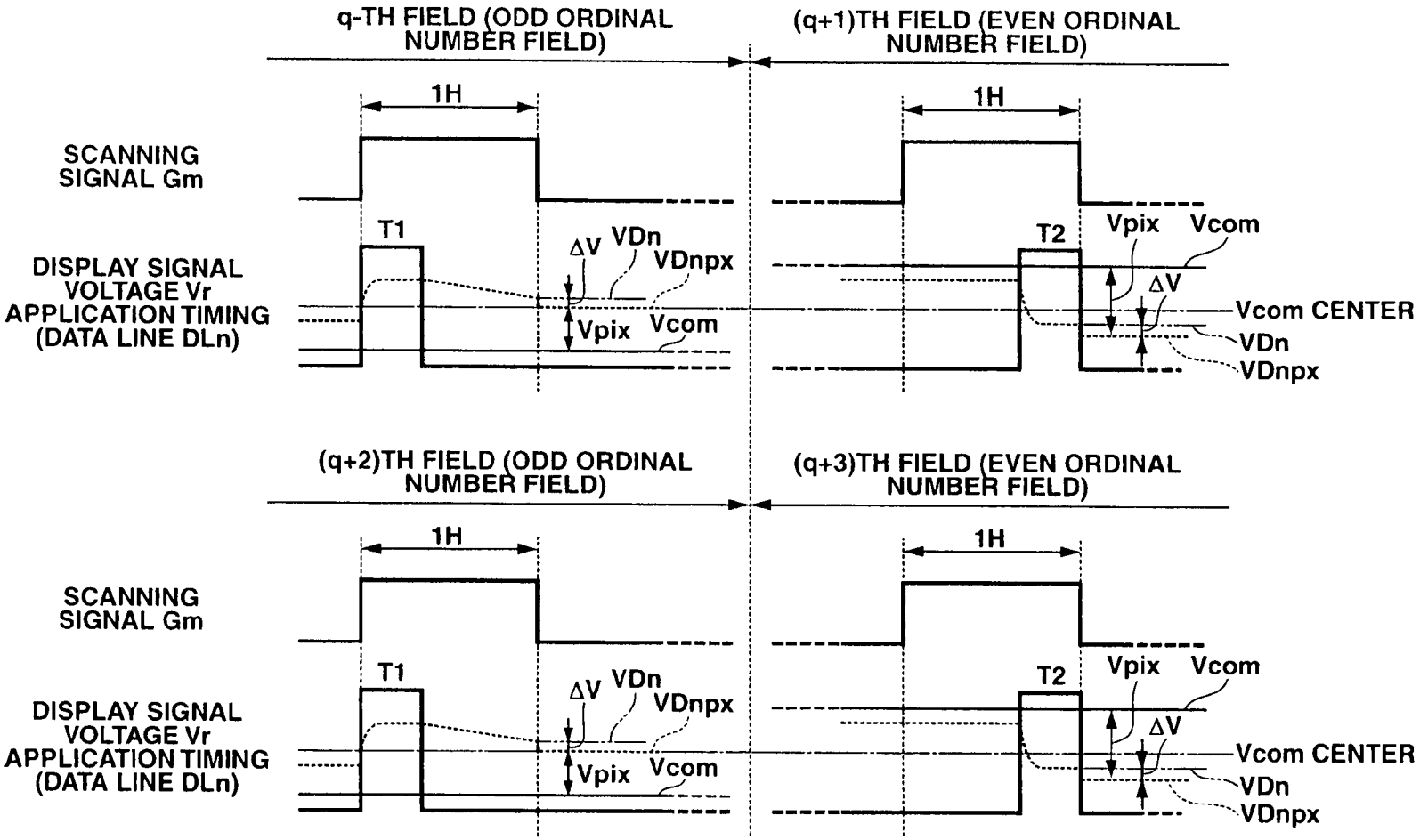
FIG. 12 is a timing chart for explaining influence of a field through voltage in the first drive control method.
Figures 13A, 13B:
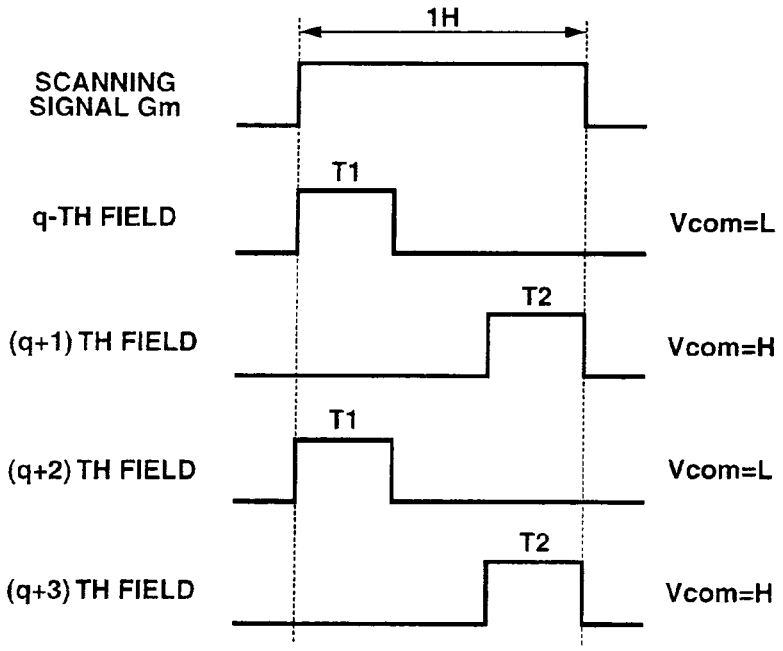
FIGS. 13A and 13B are diagrams showing the relationship between timings at which display signal voltages are applied and a pixel electrode voltage according to the first drive control method.
Figure 14:
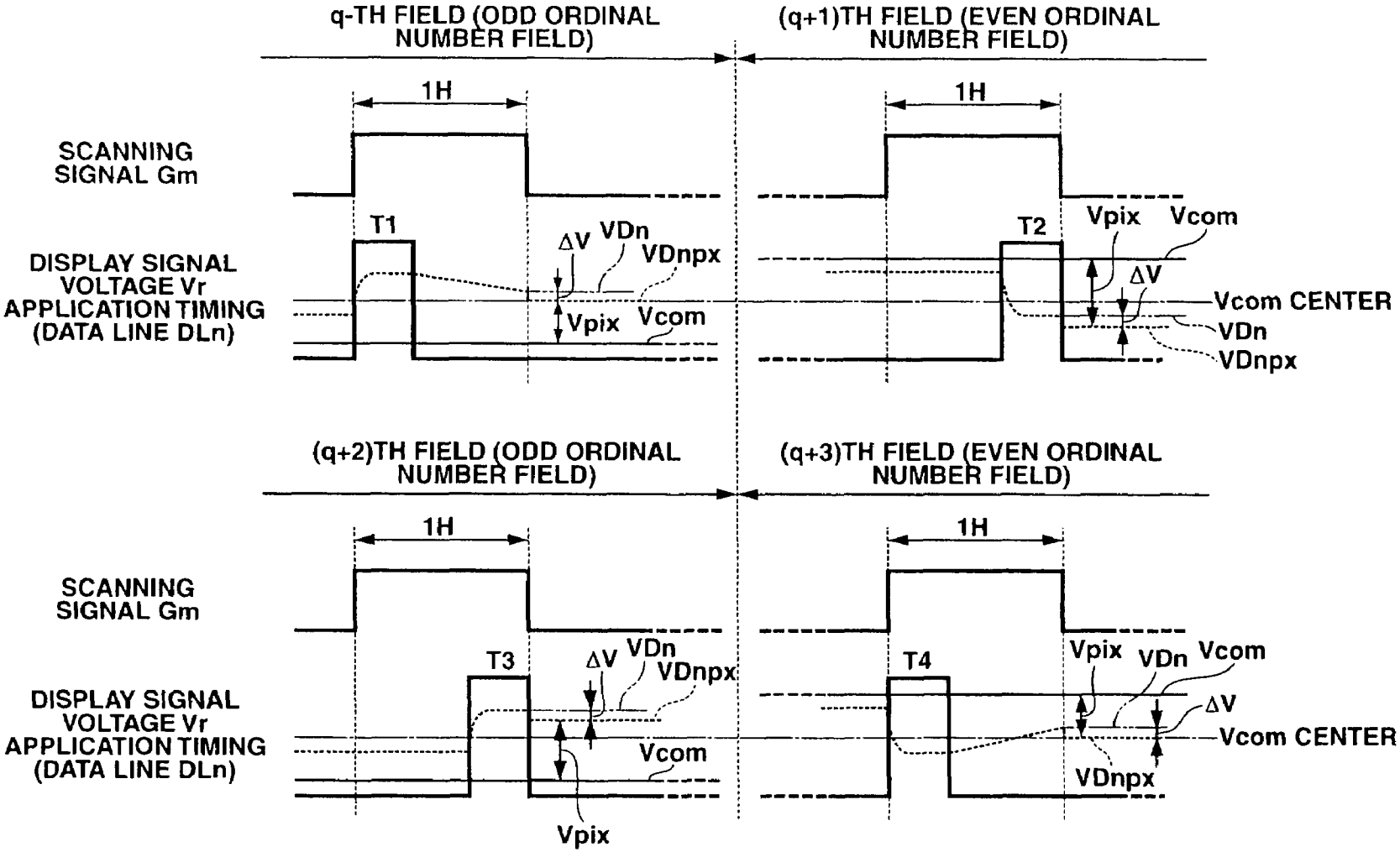
FIG. 14 is a timing chart of the substantial part showing the control concept of a third drive control method.
Figures 15A, 15B:
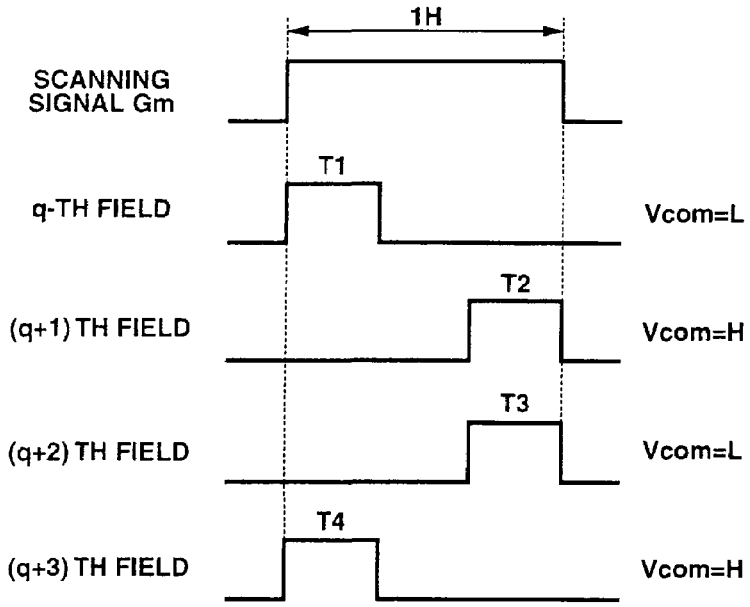
FIGS. 15A and 15B are diagrams showing the relationship between timings at which display signal voltages are applied and a pixel electrode voltage according to the third drive control method.

FIG. 12 is a timing chart for explaining the influence of a field through voltage in the first drive control method. FIGS. 13A and 13B are diagrams showing the relationship between the timings at which the display signal voltages are applied and a pixel electrode voltage according to the first drive control method. FIG. 14 is a timing chart of the substantial part showing the control concept of the third drive control method. FIGS. 15A and 15B are diagrams showing the relationship between the timings at which the display signal voltages are applied and a pixel electrode voltage according the third drive control method.

According to the above-described first and second drive control methods, unevenness in the luminance (deterioration of the display quality), which is due to a decrease in the pixel potential caused by leakage of charges written and stored in the display pixels Px in a selected period (horizontal period), is suppressed. According to the third drive control method, burn-in in the liquid crystal and deterioration of the display quality are suppressed by further taking into consideration the influence caused by a decrease in the pixel potential due to a field through voltage ΔV which is inherent in a liquid crystal display panel.

According to the first and second drive control methods, the dividing operation by the dividing multiplexer 136 is controlled such that the order of applying the display signal voltages Vr, Vg, and Vb is switched between the normal order of Vr-Vg-Vb and the reverse order of Vb-Vg-Vr at least per field period, as shown in FIG. 6. Therefore, concerning a specific scanning line SLm and a specific data line DLn, as shown in FIG. 12 and FIG. 13A, the display signal voltage Vr is applied to the data line DLn by the source driver 130A (diving multiplexer 136) at the earliest timing Ti in a selected period (1H) set by a scanning signal Gm in a q-th field period, a (q+2)th field period, . . . which are odd ordinal number field periods. On the other hand, the display signal voltage Vr is applied to the data line DLn at the last timing T2 in the selected period (1H) in a (q+1)th field period, a (q+3)th field period, . . . which are even ordinal number field periods.

As well known, a field inverting drive method and a line inverting drive method are applied to a liquid crystal display panel in order to prevent burn-in caused by application of a direct-current voltage to the liquid crystal. Due to these methods, for example, as shown in FIG. 12, a common voltage Vcom is set at a lower potential than the center voltage (Vcom center) of the common voltage (Vcom=L) in an odd ordinal number field period. The display signal voltage Vr (data line voltage VDn) to be applied to the data line DLn by the source driver 130A is set at a higher potential than the common voltage Vcom. On the other hand, the common voltage Vcom is set at a higher potential than the Vcom center (Vcom=H) in an even ordinal number field period. As a result, the display signal voltage Vr (data line voltage VDn) to be applied to the data line DLn by the source driver 130A is set at a lower potential than the common voltage Vcom.

In this case, as explained in the first drive control method, charges stored in the display pixels Px are leaked via the protection element provided to the data line DLn in the remaining selected period after the writing operation is completed. Along with this, when the selected period ends (supply of the scanning signal Gm is cut; application of the scanning signal Gm of a low level is started), a voltage drop amounting to a well-known field through voltage ΔV occurs. Accordingly, a substantial pixel potential Vpix stored in a display pixel Px amounts to the difference between a voltage (pixel electrode voltage) VDnpx obtained by subtracting the field through voltage ΔV from the data line voltage VDn immediately before the selected period ends, and the common voltage Vcom.

In an odd ordinal number field period in which the display signal voltage Vr (data line voltage VDn) set at a higher potential than the common voltage Vcom is applied, the data line voltage VDn decreases due to the leakage of charges after writing operation at the timing T. As shown in FIG. 12, the pixel electrode voltage VDnpx changes in a direction approaching the Vcom center (or the common voltage Vcom) by further decreasing from the data line voltage VDn by the field through voltage ΔV. On the other hand, in an even ordinal number field period in which the display signal voltage Vr (data line voltage VDn) set at a lower potential than the common voltage Vcom is applied, the data line voltage VDn has almost no leakage of charges caused after writing operation at the timing T2. The pixel electrode voltage VDnpx changes in a direction going away from the Vcom center (or the common voltage Vcom) by decreasing from the data line voltage VDn by the field through voltage ΔV. Accordingly, in a case where assumed that the difference between the pixel electrode voltage VDnpx and the Vcom center in an odd ordinal number field period is "±0" (reference), the difference between the pixel electrode voltage VDnpx and the Vcom center in an even ordinal number field period is always "−" (negative). As a result, the frequency of a direct current component being applied to the liquid crystal with the pixel potential Vpix biased to the negative side is high, possibly causing burn-in in the liquid crystal and flickers in the display image.

Hence according to the third drive control method, as shown in FIG. 14 and FIG. 15A, concerning a specific scanning line SLm and a specific data line DLn in the above-described liquid crystal display apparatus, the display signal voltage Vr is applied to the data line DLn by the source driver 130A (dividing multiplexer 136) at the earliest timing T1 in a selected period (1H) set by a scanning signal Gm in a q-th field period. On the other hand, in a (q+1)th field period, the display signal voltage Vr is applied to the data line DLn at the last timing T2 in the selected period (1H). Four continuous field periods are set as one cycle wherein a q-th field period and a (q+2)th field period are odd ordinal number field periods and a (q+1)th field period and a (q+3)th field period are even ordinal number field periods. In the same manner, in the (q+2)th field period which is an odd ordinal number field period, the display signal voltage Vr is applied to the data line DLn at the last timing T3 in the selected period (1H). On the other hand, in the (q+3)th field period which is an even ordinal number field period, the display signal voltage Vr is applied to the data line DLn at the earliest timing T4 in the selected period (1H).

As shown in FIG. 14, the common voltage Vcom is set at a lower potential than the Vcom center (Vcom=L) in an odd ordinal number field period, as described above. And the display signal voltage Vr (data line voltage VDn) set at a higher potential than the common voltage Vcom is applied to the data line DLn. On the other hand, in an even ordinal number field period, the common voltage Vcom is set at a higher potential than the Vcom center (Vcom=H). And the display signal voltage Vr (data line voltage VDn) set at a lower potential than the common voltage Vcom is applied to the data line DLn.

The pixel electrode voltage VDnpx of a display pixel Px is determined based on the charges leaked in the remaining selected period after writing operation and a voltage drop caused by a field through when the selected period ends.

Hence according to the third drive control method, as shown in FIG. 14, the data line voltage VDn decreases due to leakage of charges after writing operation at the timing T1 and timing T4 in the q-th field period (odd ordinal number field period) and in the (q+3)th field period (even ordinal number field period). The pixel electrode voltage VDnpx of a display pixel Px further decreases from the data line voltage VDn by the field through voltage ΔV, changing in a direction approaching the Vcom center (or the common voltage Vcom).

In the (q+1)th field period (even ordinal number field period) and in the (q+2)th field period (odd ordinal number field period), the data line voltage VDn has almost no leakage of charges caused after writing operation at the timing T2 and timing T3. The pixel electrode voltage VDnpx of a display pixel Px decreases from the data line voltage VDn by the field through voltage ΔV, changing in a direction going away from the Vcom center (or the common voltage Vcom) or changing to a voltage still having a sufficient voltage difference from the Vcom center.

That is, as shown in FIG. 5B, in a case where assumed that the difference between the pixel electrode voltage VDnpx and the Vcom center at the timing T1 and timing T4 is "±0" (reference), the difference between the pixel electrode voltage VDnpx and the Vcom center at the timing T2 is "−" (negative). On the other hand, the difference between the pixel electrode voltage VDnpx and the Vcom center at the timing T3 is "+" (positive). Accordingly, in the case where four field periods are set as one cycle, the bias in the pixel potential Vpix is removed and the direct current component to be applied to the liquid crystal is canceled. As a result, burn-in in the liquid crystal and occurrence of flickers can be prevented.

(Fourth Drive Control Method)

The following explanation will be made by timely referring to the configuration of the above-described liquid crystal display apparatus (see FIG. 1 through FIG. 4). Explanation for the operations same as those in the first and second drive control methods will be simplified or omitted.

Figure 16:
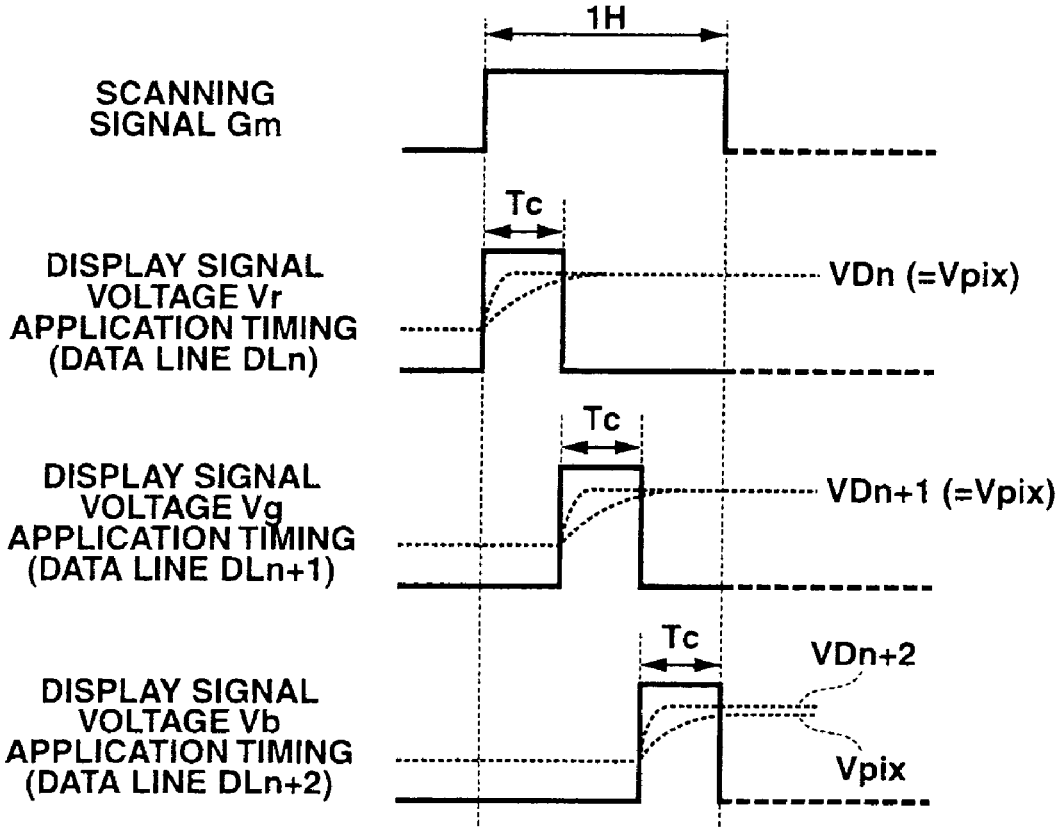
FIG. 16 is a timing chart for explaining influence of speed of writing to a display pixel according to the first to third drive control methods.
Figure 17:
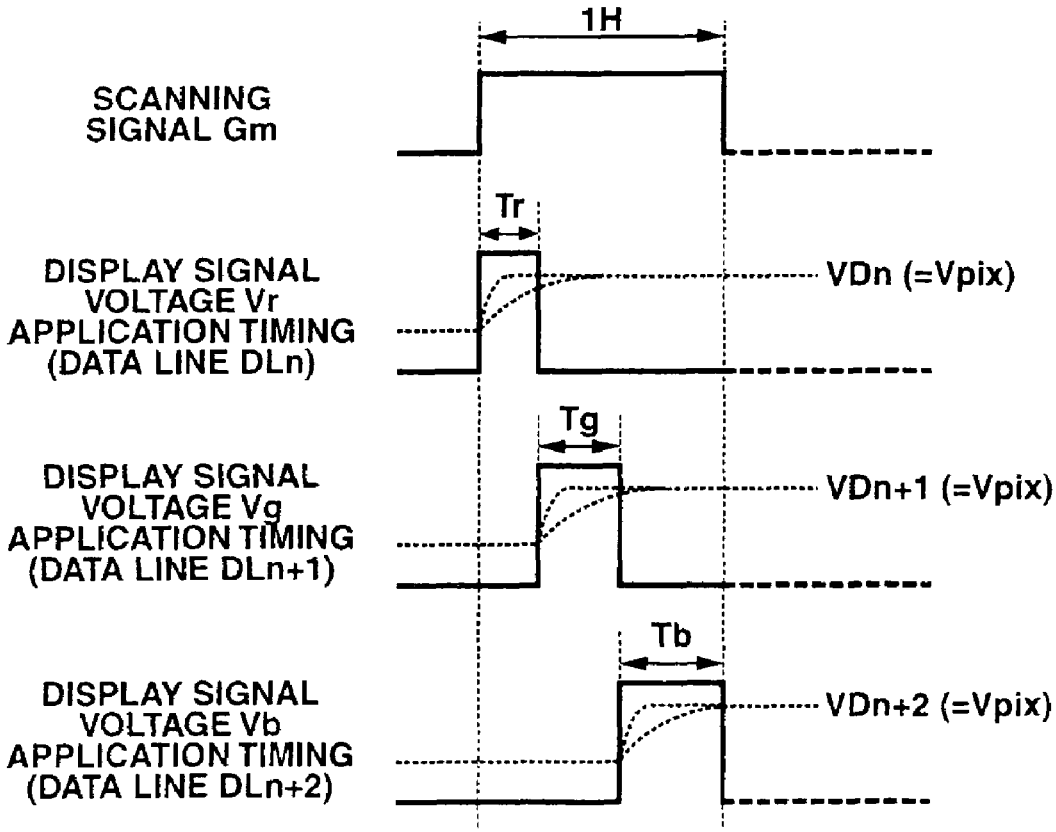
FIG. 17 is a timing chart of the substantial part showing the control concept of a fourth drive control method.

FIG. 16 is a timing chart for explaining the influence of speed at which writing operation is performed on a display pixel Px in the first to third drive control methods. FIG. 17 is a timing chart of the substantial part showing the control concept of the fourth drive control method.

In the above-described first to third drive control methods, a case has been explained where the operation of writing a display signal voltage, which is applied to a data line by the dividing multiplexer of the source driver, on a display pixel is completed within a predetermined writing period (that is, a case where the size of the pixel transistor provided in the display pixel is relatively large). As compared with this, according to the fourth drive control method, the writing period is varied in accordance with the time required for the operation of writing a display signal voltage, which time is dependent on the size of pixel transistor provided in the display pixel.

That is, for example, in a high-definition liquid crystal display panel or a compact liquid crystal display panel in which the area of each display pixel is small, the pixel transistor is formed in a small size so that the aperture ratio becomes large. In this case, the drive power of the pixel transistor becomes smaller and the time the pixel transistor takes to write the display signal voltage applied thereto from the source driver through the data line to the pixel capacitor becomes relatively long.

According to the above-described first to third drive control methods, the respective writing periods Tc which are set in a selected period are set to be equal and the time required for the operation of writing the display signal voltage to each display pixel is longer than the writing period Tc. In this case, in the display pixels Px to which the display signal voltages Vr and Vg are applied and whose pixel transistors are continuously turned on even after the set writing periods elapse because the selected period does not end at that time of elapse, the operation of writing the applied display signal voltages is completed before the selected period ends, as shown in FIG. 16. And the data line voltages VDn and VDn+1 which are based on the display signal voltages Vr and Vg become equal to the pixel potential Vpix (VDn=Vpix, VDn+1=Vpix). However, in the display pixel Px to which the display signal voltage Vb is applied and which has the selected period end generally at the same time the writing period set therefore ends, the applied display signal voltage cannot fully be written. Therefore, the pixel potential Vpix does not reach the data line voltage VDn+2 which is based on the display signal voltage Vb. As a result, the data line voltage VDn+2 and the pixel potential Vpix differ from each other (VDn+2≠Vpix) and the display quality might be deteriorated.

As compared with this, according to the fourth drive control method, in the liquid crystal display apparatus described above, the timing at which the input multiplexer 133 converts display data into pixel data and the timing at which the dividing multiplexer 136 divides the pixel data are controlled to be synchronous by the data conversion control signals. In this case, the data converting timing and the data dividing timing are controlled such that a writing period Tb, which is set at least in the last part of a selected period (1H) at the timing at which the display signal voltage Vb is applied, is set to continue until the operation of writing the display signal voltage Vb is completed, whereas the other writing periods Tr and Tg, which are set in the first and middle parts of the selected period, are set to be shorter than the writing period Tb, as shown in FIG. 17. The writing of the display signal voltage Vb is executed at a writing speed which is determined by the size of the pixel transistor TFT provided in the display pixel Px, etc.

According to this method, in the display pixels Px whose pixel transistors are continuously turned on even after the writing periods Tr and Tg elapse because of the still continuing selected period, the operation of writing the display signal voltages Vr and Vg is completed before the selected period ends. For the display pixel Px which has the selected period end generally at the same time the writing period Tb ends, the writing period Tb is set to a period which continues until the operation of writing the display signal voltage Vb is completed. Therefore, any of the display signal voltages can be written excellently. In other words, the writing amounts can be equalized. As a result, an excellent display quality can be obtained because the data line voltages VDn, VDn+1 and VDn+2 which are based on the display signal voltages Vr, Vg, and Vb correspond to the pixel potential Vpix.

In the fourth drive control method shown in FIG. 17, the influence of leakage of charged stored in the display pixels is not mentioned. However, according to the fourth drive control method, there is also a possibility that the data line voltages greatly decrease due to the leakage of charges in the remaining selected period after the writing periods Tr and Tg end. In this case, as well as the first to third drive control methods described above, the display quality can be improved or burn-in in the liquid crystal can be prevented by switching the order of applying the display signal voltages to the data lines DL between the normal order and the reverse order per field period and per scanning line.

Second Embodiment of the Display Apparatus

The second embodiment of the display apparatus according to the present invention to which the above-described drive control methods are applicable will be explained with reference to the drawings.

Figure 18:
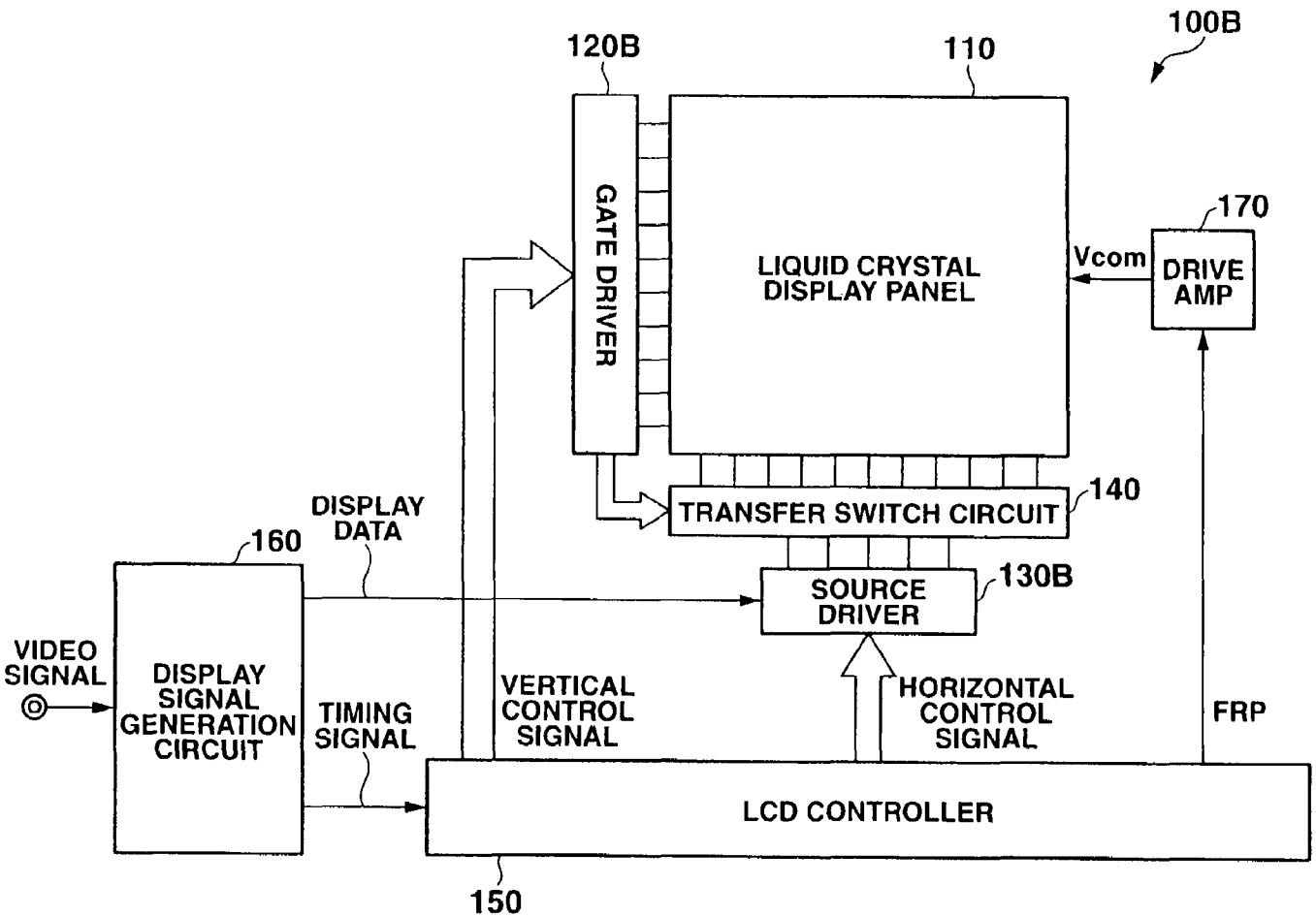
FIG. 18 is a schematic block diagram showing the entire configuration of a second embodiment of a liquid crystal display apparatus to which the display apparatus according to the present invention is applied.
Figure 19:
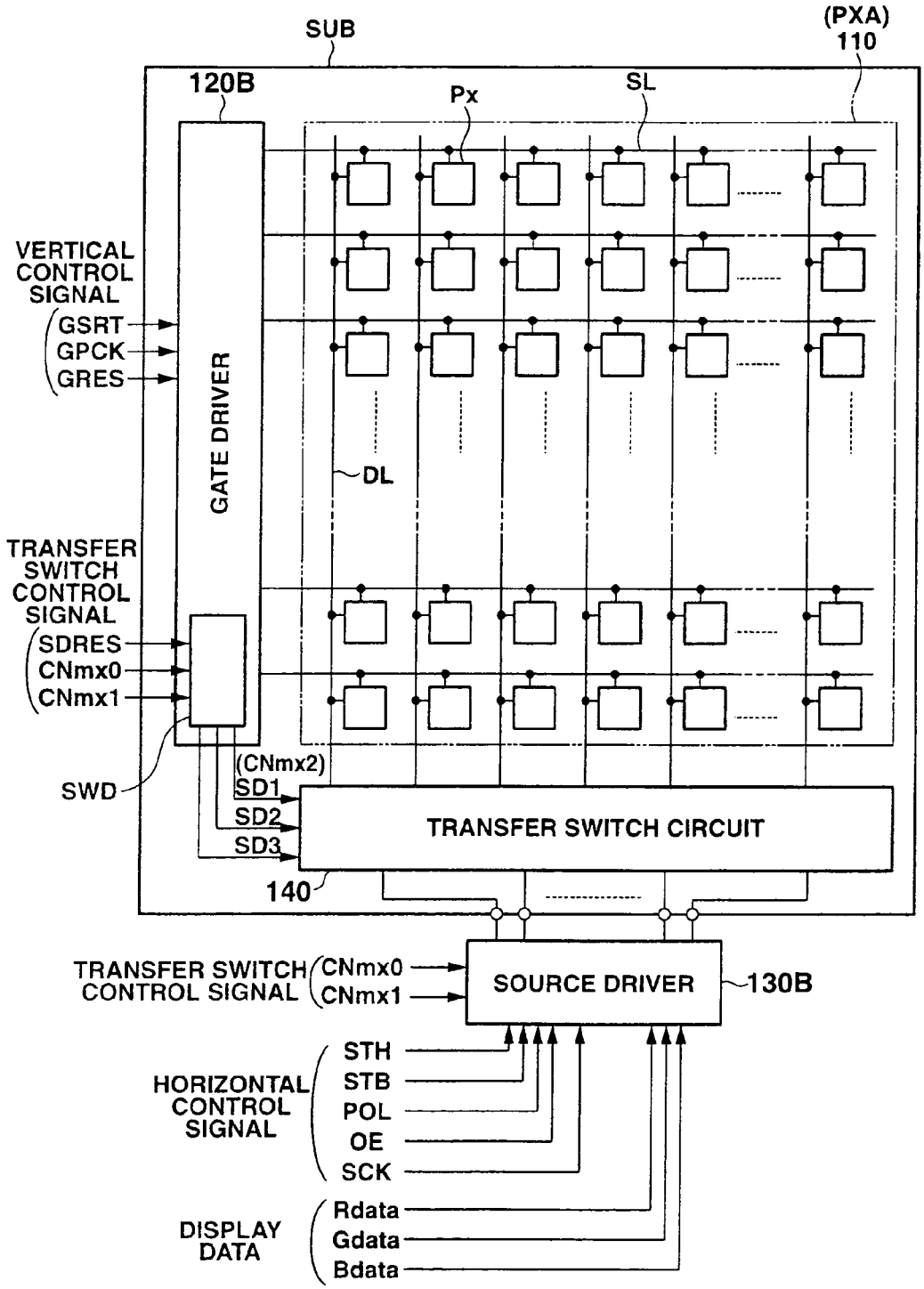
FIG. 19 is a schematic configuration diagram showing a principal part of the liquid crystal display apparatus according to the second embodiment.

FIG. 18 is a schematic block diagram showing the entire configuration of the second embodiment of the liquid crystal display apparatus to which the display apparatus according to the present invention is applied. FIG. 19 is a schematic diagram showing the configuration of the principal part of the liquid crystal display apparatus according to the second embodiment.

The elements which are the same as those in the first embodiment will be denoted by the same or similar reference numerals and explanation for such elements will be simplified or omitted.

As shown in FIG. 18 and FIG. 19, the liquid crystal display apparatus 100B according to the present embodiment comprises a liquid crystal display panel 110, a gate driver 120B, a source driver 130B, an LCD controller 150, a display signal generation circuit 160, and a common voltage drive amp (drive amp) 170, likewise the first embodiment (see FIG. 1).

The liquid crystal display apparatus 100B further comprises a transfer switch circuit (data dividing means) 140, and a switch drive circuit (switch drive controlling means) SWD as elements unique to the second embodiment. Being provided between the liquid crystal display panel 110 and the source driver 130B, the transfer switch circuit 140 dividedly applies a display signal voltage comprising serial data output from the source driver 130B to the data lines DL provided on the liquid crystal display panel 110. The switch drive circuit SWD is formed integrally in the gate driver 120B, and generates and outputs a multiplexer control signal CNmx2 (switch toggling signals SD1 to SD3) for driving the transfer switch circuit 140.

According to the second embodiment, such a configuration as shown in FIG. 19 in which at least a pixel array PXA having a plurality of display pixels Px constituting the liquid crystal display panel 110 arranged two-dimensionally, the gate driver 120B and the transfer switch circuit 140 are integrally formed on an insulating substrate SUB formed of a grass substrate or the like, can be employed.

The source driver 130B is formed as a driver chip independent from the insulating substrate SUB. The source driver 130B is electrically connected to the insulating substrate SUB via wiring electrodes (connection points) formed on the insulating substrate SUB, and is structured as an external (add-on) component of the insulating substrate SUB.

In this case, the pixel transistors (corresponding to the pixel transistors TFT shown in FIG. 22) constituting the display pixels Px, and the gate driver 120B and transfer switch 140 (thin film transistors or the like) to be described later can be formed through the same production process with the use of amorphous silicon. Because of this, a liquid crystal display apparatus can be manufactured at a low cost through an already technically established production process of amorphous silicon and a functional device having a stable operation property can be obtained. As a result, the display property of a liquid crystal display apparatus can be improved.

Figure 20:
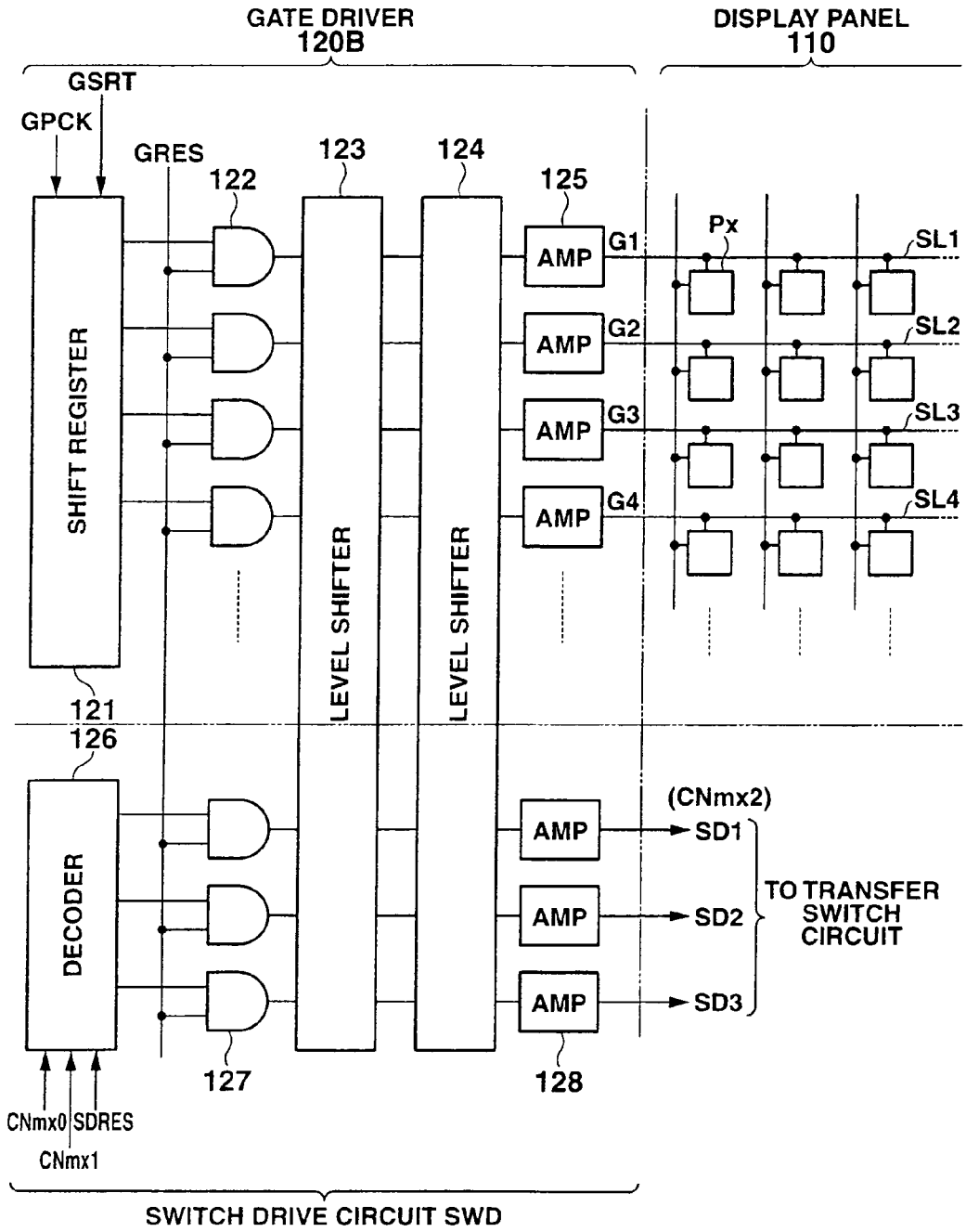
FIG. 20 is a schematic configuration diagram showing an example of a gate driver and switch drive circuit which are applied to the liquid crystal display apparatus according to the second embodiment.

FIG. 20 is a schematic configuration diagram showing one example of the gate driver and switch drive circuit to be applied to the liquid crystal display apparatus according to the second embodiment.

The following explanation will be made by timely referring to the configurations shown in FIG. 18 and FIG. 19.

As shown in FIG. 20, the gate driver 120B comprises the integrally-formed switch drive circuit (switch drive controlling means) SWD for driving the transfer switch circuit 140, in addition to the elements of the gate driver 120A shown in FIG. 2.

As shown in FIG. 29, the switch drive circuit SWD comprises a decoder 126, AND circuits 127, plural-staged level shifters (same as the level shifters 123 and 124 of the gate driver 120B), and output amps 128. The decoder 126 sequentially outputs decoded signals at predetermined timings based on data conversion control signals (multiplexer control signals CNmx0 and CNmx1 and switch reset signal SDRES) which are supplied from the LCD controller 150. The AND circuit 127 receives a decoded signal output from the decoder 126 as an input to its one input point and receives a gate reset signal GRES supplied from the LCD controller 150 as an input to its other input point, likewise the AND circuit 122 of the gate driver 120B. The plural-staged level shifters set a signal output from the AND circuit 127 to a predetermined signal level. In the switch drive circuit SWD having this configuration, a decoded signal generated by the decoder 126 is input to one input point of the AND circuit 127 based on the data conversion control signals supplied from the LCD controller 150. In the switch drive circuit SWD, switch toggling signals SD1 to SD3 (multiplexer control signal CNmx2) are generated and output in a state where the above-described reset signal GRES is set to a high level (driven state of the gate driver 120B). The switch toggling signals SD1 to SD3 control transfer gates TG1 to TG3 included in the transfer switch circuit 140, based on the data conversion control signals supplied from the LCD controller 150.

The source driver 130B includes the same elements as those of the source driver 130A shown in FIG. 3 except the transfer switch section. The source driver 130B sequentially acquires plural lines of display data Rdata, Gdata, and Bdata supplied in parallel from the display signal generation circuit 160. The source driver 130B causes the input multiplexer (first data conversion circuit) 133 to convert the acquired display data into pixel data RGBdata in one line comprising serial data based on the data conversion control signals (multiplexer control signals CNmx0 and CNmx1). The source driver 130B causes the D/A converter 134 to analog-convert the pixel data RGBdata and output the analog-converted pixel data RGBdata to the transfer switch circuit 140 via the wiring electrodes (connection points) in the form of display signal voltage Vrgb comprising serial data.

The transfer switch circuit 140 is roughly the same as the transfer switch section shown in FIG. 3. The transfer switch circuit 140 divides the display signal voltage Vrgb supplied in the form of serial data from the source driver 130B, based on the data conversion control signals (multiplexer control signals CNmx0 and CNmx1 and switch reset signal SDRES), so that individual display signal voltages corresponding to the respective data lines are sequentially applied thereto.

Accordingly, it is possible to improve the display quality and product life of the display apparatus according to the second embodiment by applying the above-described drive control methods for suitably suppressing occurrence of flickers due to leakage of charges stored in the display pixels, burn-in in the liquid crystal due to a biased pixel potential, writing defect due to the speed of writing in the display pixel (pixel transistor), etc.

In the display apparatus according to the second embodiment, the source driver 130B converts the display signal voltages to be supplied to the display pixels Px connected to the data lines DL provided on the liquid crystal display panel 110 (pixel array PXA), into time-division serial data for each data line group including a plurality of data lines DL. The source driver 130B outputs the time-division serial data to the transfer switch circuit 140 which is formed integrally with the pixel array PXA on the insulating substrate SUB. With this configuration, the time-division serial data for each data line group can be divided by the transfer switch circuit 140 at time division timings, and can be sequentially applied to the data lines DL in each data line group in a predetermined order. Therefore, the transfer switch circuit 140 provided on the insulating substrate SUB and the source drive 130B provided independently from the insulating substrate SUB can be connected by a number of connection terminals corresponding to the number of groups of data lines DL.

Accordingly, it is possible to reduce the number of connection terminals between the liquid crystal display panel 110 and the source driver 130B to 1/given number (1/number of data lines included in each data line group) and design the connection terminals with a relatively large pitch. As a result, the number of steps required for the connection process can be reduced and the liquid crystal display panel 110 and the source driver 130B can be suitably connected even with a relatively low connection precision, making it possible to reduce the production cost.

In the above-described embodiments, a case has been explained where the display apparatus according to the present invention is applied to a liquid crystal display apparatus. However, the present invention is not limited to this. The present invention can be applied not only to a liquid crystal display panel but also to other display panels such as an organic EL (electroluminescence) panel, etc. Further, in a case where the present invention is applied to a display panel conforming to an active-matrix type drive system, the gate driver and the switch drive circuit can be integrally formed. Therefore, a shared circuit configuration and a shared drive control method (processing of control signals, etc.) can be applied to the gate driver and switch drive circuit.

Various embodiments and changes may be made thereunto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application is based on Japanese Patent Application No. 2003-435928 filed on Dec. 26, 2003 and including specification, claims, drawings and summary. The disclosure of the above Japanese Patent Application is incorporated herein by reference in its entirety.

What is claimed is:

1. A display drive device for driving a display panel based on display data including display data of a plurality of different color components, wherein the display panel includes a plurality of signal lines, a plurality of scanning lines intersecting the signal lines, and display pixels which are arranged adjacent to intersections, respectively, of the signal lines with the scanning lines, said display drive device comprising:

a data holding circuit which acquires the display data including the display data of the plurality of different color components and holds the display data of the plurality of different color components in parallel with one another;

a first data conversion circuit which arranges, in time-series and in a predetermined arranging order, the display data of the plurality of different color components held by said data holding circuit;

a display signal voltage generation circuit which generates display signal voltages, which correspond respectively to the display data of the plurality of different color components, and which are to be applied to the display pixels via the signal lines;

a second data conversion circuit which is provided for each predetermined number of signal lines, the predetermined number corresponding to a number of said color components, and which sequentially selects, in the predetermined arranging order, the display signal voltages corresponding respectively to the display data of the plurality of different color components, and which applies each said selected display signal voltage to one of the predetermined number of signal lines that corresponds to the same color component as the selected display signal voltage; and a control section which changes, at a predetermined cycle, said predetermined arranging order in which the display data of the plurality of different color components are arranged by the first data conversion circuit.

2. The display drive device according to claim 1, wherein the control section reverses the predetermined arranging order per field period in which a display operation for one screen of the display panel is performed.

3. The display drive device according to claim 1, wherein the control section reverses the predetermined arranging order per horizontal period in which a display operation for one row of the display panel is performed.

4. The display drive device according to claim 1, wherein the control section sets the predetermined arranging order such that fluctuations in pixel potentials stored in the display pixels based on the display signal voltages applied via the signal lines are canceled in a predetermined plural number of field periods set as one said predetermined cycle.

5. The display drive device according to claim 4, wherein four field periods are set as one cycle, and the control section sets the predetermined arranging order in second and third field periods, of the one cycle to be reversed with respect to the predetermined arranging order in first and fourth field periods of the one cycle.

6. The display drive device according to claim 1, wherein the second data conversion circuit includes a plurality of switches which apply the display signal voltages to the signal lines, respectively, and the control section includes a switch drive control circuit which generates, based on a timing signal, switch toggling signals for controlling electrical conductivity of the plurality of switches in the second data conversion circuit.

7. A display apparatus for displaying desired image information on a display panel based on display data including display data of a plurality of different color components, the display panel including a plurality of signal lines, a plurality of scanning lines which are orthogonal to and intersect the signal lines, and a plurality of display pixels which are arranged adjacent to intersections, respectively, of the signal lines with the scanning lines, said display apparatus comprising:

a scanning drive circuit which sequentially applies scanning signals to the plurality of scanning lines to set the display pixels to a selected state;

a data holding circuit which acquires the display data, which is supplied from outside and which includes the display data of the plurality of different color components, and which holds the display data of the plurality of different color components in parallel with one another;

a first data conversion circuit which arranges, in a predetermined arranging order and in time-series, the display data of the plurality of different color components held by said data holding circuit;

a display signal voltage generation circuit which generates display signal voltages, which correspond respectively to the display data of the plurality of different color components, and which are to be applied to the display pixels via the signal lines;

a second data conversion circuit which is provided for each predetermined number of signal lines, the predetermined number corresponding to a number of said color components, and which sequentially selects, in the predetermined arranging order, the display signal voltages corresponding respectively to the display data of the plurality of different color components, and which applies each said selected display signal voltage to one of the predetermined number of signal lines that corresponds to the same color component as the selected display sicinal voltage; and a control section which changes, at a predetermined cycle, said predetermined arranging order in which the display data of the plurality of different color components are arranged by the first data conversion circuit.

8. The display drive device according to claim 7, wherein the control section reverses the predetermined arranging order per field period in which a display operation for one screen of the display panel is performed.

9. The display apparatus according to claim 7, wherein the control section reverses the predetermined arranging order per horizontal period in which a display operation for one row of the display panel is performed.

10. The display apparatus according to claim 7, wherein the control section sets the predetermined arranging order such that fluctuations in pixel potentials stored in the display pixels based on the display signal voltages applied via the signal lines are canceled in a predetermined plural number of field periods set as one said predetermined cycle.

11. The display apparatus according to claim 7, wherein at least the second data conversion circuit is integrally formed on a single insulating substrate on which the display panel is formed.

12. The display apparatus according to claim 7, wherein the second data conversion circuit includes a plurality of switches which apply the display signal voltages to the signal lines, respectively, and the control section includes a switch drive control circuit which generates, based on a timing signal, switch toggling signals for controlling electrical conductivity of the plurality of switches in the second data conversion circuit.

13. The display apparatus according to claim 12, wherein the switch drive control circuit is formed integrally with the scanning drive circuit.

14. The display apparatus according to claim 7, wherein each of the plurality of display pixels comprises:

a pixel transistor including a gate electrode connected to one of the scanning lines that is adjacent to the display pixel, a drain electrode connected to one of the signal lines that is adjacent to the display pixel, and a source electrode which is connected to a pixel electrode;

a pixel capacitor which is formed of liquid crystal molecules sealed between the pixel electrode and a common electrode which is opposed to the pixel electrode and provided in common for the display pixels; and a compensating capacitor which is connected in parallel to the pixel capacitor; and wherein an orientation state of the liquid crystal molecules of the pixel capacitor is controlled by the display signal voltage, which is applied to the pixel electrode via the pixel transistor.

15. A drive control method for a display drive device for driving a display panel based on display data including display data of a plurality of different color components, wherein the display panel includes a plurality of signal lines, a plurality of scanning intersecting the signal lines, and display pixels which are arranged adjacent to intersections, respectively, of the signal lines with the scanning lines, said method comprising:

acquiring the display data including the display data of the plurality of different color components and holding the display data of the plurality of different color components in parallel with one another;

arranging, in a predetermined arranging order and in time-series, the held display data of the plurality of different color components;

generating display signal voltages which correspond respectively to the display data of the plurality of different color components;

sequentially selecting, in the predetermined arranging order, the display signal voltages corresponding respectively to the display data of the plurality of different color components, and applying each said selected display signal voltage to one of the signal lines that corresponds to the same color component as the selected display signal voltage; and changing, at a predetermined cycle, said predetermined arranging order.

16. The drive control method of the display drive device according to claim 15, wherein the changing of the predetermined arranging order is performed per field period in which a display operation for one screen of the display panel is performed.

17. The drive control method of the display drive device according to claim 15, wherein the changing of the predetermined arranging order is performed per horizontal period in which a display operation for one row of the display panel is performed.

18. The drive control method of the display drive device according to claim 15, wherein the changing of the predetermined arranging is performed such that fluctuations in pixel potentials stored in the display pixels based on the display signal voltages applied via the signal lines are canceled in a predetermined plural number of field periods set as one said predetermined cycle.

19. A display drive device for driving a display panel based on display data comprising a plurality of different color components, wherein the display panel includes a plurality of signal lines, a plurality of scanning lines intersecting the signal lines, and display pixels which are arranged adjacent to intersections of the signal lines with the scanning lines, the display drive device comprising:

a data holding circuit which: (i) is provided for a number of signal lines, said number corresponding to a number of the color components, and said number of signal lines corresponding respectively to the color components, (ii) acquires display data comprising the plurality of color components, and (ii) holds in parallel the plurality of different color components of the display data;

a data distribution circuit which converts each color component held in parallel by the data holding circuit into a display signal voltage, and which applies the display signal voltages corresponding to the color components to the signal lines that correspond to the color components, in a predetermined order and in a time-division manner;

a control section which changes the order of application of the display signal voltages applied in the time-division manner by the data distribution circuit, at a predetermined cycle.

20. The display drive device according to claim 19, wherein said control section changes the order of application per field period in which a display operation for one screen of said display panel is performed.

21. The display drive device according to claim 19, wherein said control section changes the order of application per horizontal period in which a display operation for one row of said display panel is performed.

22. The display drive device according to claim 19, wherein the color components of the display data comprise red, green and blue color components, and the control section switches, at the predetermined cycle, the order of application between an order of red, green and blue and an order of blue, green and red.

23. The display drive device according to claim 19, wherein the display data comprises three color components, including a green color component, and the control section controls the order of application such that the green component is applied second in the order of the time-divisional application by the distribution circuit, both before and after the order of application is changed.

24. A display apparatus for displaying desired image information on a display panel based on display data comprising a plurality of different color components, the display panel including a plurality of signal lines, a plurality of scanning lines which are orthogonal to and intersect the signal lines, and a plurality of display pixels which are arranged adjacent to intersections of the signal lines with the scanning lines the display apparatus comprising:

a scanning drive circuit which sequentially applies scanning signals to the plurality of scanning lines to set the display pixels to a selected state;

a data holding circuit which: (i) is provided for a number of signal lines, said number corresponding to a number of the color components, and said number of signal lines corresponding respectively to the color components, (ii) acquires display data comprising the plurality of color components, and (ii) holds in parallel the plurality of different color components of the display data;

a data distribution circuit which converts each color component held in parallel by the data holding circuit into a display signal voltage, and which applies the display signal voltages corresponding to the color components to the signal lines that correspond to the color components, in a predetermined order and in a time-division manner;

a control section which changes the order of application of the display signal voltages applied in the time-division manner by the data distribution circuit, at a predetermined cycle.

25. A drive control method for a display drive device for driving a display panel based on display data comprising a plurality of different color components, wherein the display panel includes a plurality of signal lines, a plurality of scanning lines intersecting the signal lines, and display pixels which are arranged adjacent to intersections of the signal lines with the scanning lines, the method comprising:

acquiring display data comprising the plurality of color components, and holding in parallel the plurality of different color components of the display data, the capturing and holding being executed for a number of the signal lines, said number corresponding to a number of the color components, and said number of signal lines corresponding respectively to the plurality of color components;

converting each color component held in parallel into a display signal voltage, and applying the display signal voltages corresponding to the color components to the signal lines that correspond to the color components, in a predetermined order and in a time-division manner; and changing the order of application of the display signal voltages applied in the time-division manner to the signal lines, at a predetermined cycle.

* * * * *